US006390612B1

(12) United States Patent
Kotaki et al.

(10) Patent No.: US 6,390,612 B1
(45) Date of Patent: May 21, 2002

(54) METHOD FOR FILLING INK HOLDING MEMBER WITH INK, INK FILLING APPARATUS, AND INK TANK TO BE FILLED WITH INK BY INK FILLING METHOD

(75) Inventors: Yasuo Kotaki, Yokohama; Tsutomu Abe, Isehara; Nobuyuki Hatasa; Masashi Ogawa, both of Kawasaki, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/645,315

(22) Filed: Aug. 25, 2000

(30) Foreign Application Priority Data

Aug. 30, 1999 (JP) ..... 11-243536

(51) Int. Cl.[7] ..... B41J 2/175
(52) U.S. Cl. ..... 347/85
(58) Field of Search ..... 347/85, 86, 87, 347/92, 39; 141/72, 69

(56) References Cited

U.S. PATENT DOCUMENTS 5,351,073 A * 9/1994 Kageyama et al. ..... 347/87
5,367,328 A * 11/1994 Erickson ..... 347/7
5,751,300 A * 5/1998 Cowger et al. ..... 347/6

FOREIGN PATENT DOCUMENTS

| | | | |
|---|---|---|---|
| EP | 639501 | | 2/1995 |
| EP | 1 080 913 | * | 3/2001 |
| GB | 2322596 | | 9/1998 |
| JP | 8-90785 | | 4/1996 |
| JP | 8-112905 | | 5/1996 |

* cited by examiner

*Primary Examiner*—Michael P. Nghiem
(74) *Attorney, Agent, or Firm*—Fitzpatrick, Cella, Harper & Scinto

(57) ABSTRACT

To provide an ink filling method for pouring ink into an ink tank to be mounted to a printer, an ink filling apparatus, and the ink tank to be properly filled with the ink by the ink filling method. The ink filling method includes the steps of: pouring a predetermined amount of ink into a housing in a state in which an ink holding member is opened to the atmosphere, and filling the ink holding member with the ink by imparting, to the ink poured, an inertial force, which is greater than a sum of a static ink holding force of the ink holding member and a dynamic resistant force to movement of the ink.

17 Claims, 18 Drawing Sheets

METHOD FOR FILLING INK HOLDING MEMBER WITH INK, INK FILLING APPARATUS, AND INK TANK TO BE FILLED WITH INK BY INK FILLING METHOD

BACKGROUND OF THE INVENTION

1. Field of the Invention

The present invention relates to an ink filling method for pouring ink into an ink tank to be mounted to a printer, an ink filling apparatus, and the ink tank to be properly filled with the ink by the ink filling method.

2. Related Background Art

Conventionally, various types of printers have been used, and as their examples, laser printers and ink jet printers are known. The ink jet printer is used to form an image by discharging an ink droplet onto a recording medium, and currently, structure in which an ink tank containing ink liquid is detachably mounted is generally used.

In such an ink tank, an ink holding member capable of holding ink liquid therein, using urethane foam whose film has been removed, felt or the like, is housed within a housing thereof.

As the simplest method of methods for filling the ink holding member in the ink tank with ink, there is known a so-called compression filling method for setting the interior of the ink tank in an atmosphere-open state and filling it with ink by pressurizing using compression means such as a syringe through an ink filling opening provided in the housing of the ink tank.

In Japanese Patent Application Laid-Open No. 8-112905, there has been disclosed an ink filling method for focusing attention to a bubble remaining within the ink holding member in this compression filling method and applying oscillation such as supersonic wave to the ink tank in order to remove the bubble.

On the other hand, in recent years, such an ink holding member may be configured by fibers made of thermoplastics material such as, for example, PP (Polyurethane) and PE (Polyethylene) in terms of a so-called environmental problem.

In the ink holding member made of thermoplastics fibers, however, when the ink holding member is filled with ink under pressure, it is difficult to uniformly fill the ink holding member with ink in a short time because the fibers display hydrophobic nature to ink, depending upon the ink to be used.

By using the method displaced in the Japanese Patent Application Laid-Open No. 8-112905, the present inventor et al. conducted an experiment of filling the ink holding member with ink by applying oscillation to the ink tank, but could not cause it to uniformly hold the ink.

SUMMARY OF THE INVENTION

The present invention has been recalled by focusing attention to the above described problem peculiar to resin fibers, and its main object is to provide an ink filling method and apparatus having few variations, capable of substantially uniformly filling the ink holding member with a predetermined amount of ink although it is a simple method.

It is a second object according to the present invention to provide an ink tank, to which the ink filling method according to the present invention is suitably applied.

As an ink filling method according to the present invention, there is provided an ink filling method for filling, with ink, an ink holding member in an ink tank, which comprises an ink holding member for holding ink, an ink supply port for containing the ink holding member and supplying the ink in the ink holding member to the outside, and a housing having an atmosphere communication port for communicating the ink holding member to the atmosphere, comprising the steps of: pouring a predetermined amount of ink into the housing in a state in which the ink holding member is opened to the atmosphere; and filling the ink holding member with the ink by imparting, to the ink poured, an inertial force, which is greater than a sum of a static ink holding force of the ink holding member and a dynamic resistant force to movement of the ink.

As an ink filling apparatus according to the present invention, there is provided an ink filling apparatus for filling, with ink, an ink holding member in an ink tank, which comprises: an ink holding member for holding ink; an ink supply port for containing the ink holding member and supplying the ink in the ink holding member to the outside; and a housing having an atmosphere communication port for communicating the ink holding member to the atmosphere, further comprising: an ink supply mechanism for pouring ink into an ink filling opening in the ink tank; and an inertial force imparting mechanism for imparting, to the ink to be supplied by the ink supply mechanism, an inertial force, which is greater than a sum of a static ink holding force of the ink holding member and a dynamic resistant force to movement of the ink.

As an ink tank according to the present invention, there is provided an ink tank comprising: an ink holding member for holding ink; an ink supply port for containing the ink holding member and supplying the ink in the ink holding member to the outside; and a housing having an atmosphere communication port for communicating the ink holding member to the atmosphere, wherein the ink holding member is made of a multiplicity of fibers having hydrophobic nature to ink, wherein a predetermined amount of ink is poured into the housing through the ink supply port in a state in which the ink holding member is opened to the atmosphere, and an inertial force, which is greater than a sum of a static ink holding force of the ink holding member and a dynamic resistant force to movement of the ink, is imparted to the ink poured, whereby the ink holding member is filled with the ink, and wherein the fibers are focused in the substantially same direction intersecting a direction of the inertial force imparted.

As an ink tank according to still another embodiment of the present invention, there is provided an ink tank comprising: an ink holding member for holding ink; an ink supply port for containing the ink holding member and supplying the ink in the ink holding member to the outside; and a housing having an atmosphere communication port for communicating the ink holding member to the atmosphere, wherein the ink holding member is made of a multiplicity of fibers having hydrophobic nature to the ink, wherein a predetermined amount of ink is poured into the housing through the ink supply port in a state in which the ink holding member is opened to the atmosphere, and an inertial force, which is greater than a sum of a static ink holding force of the ink holding member and a dynamic resistant force to movement of the ink, is imparted to the ink poured, whereby the ink holding member is filled with the ink, and wherein the fibers are focused in the substantially same direction as a direction of the inertial force imparted, and at least one of end surfaces of the fibers on both sides abuts upon the inner surface of the ink tank.

In this respect, various types of means in the present invention can be formed so as to implement the function. For example, functions implemented within computers by means of an exclusive hardware, a computer imparted with an appropriate function by a program, and an appropriate program, and combinations of these functions are allowed.

In the present invention, when ink is supplied from the outside, it is called "pouring," and when ink is held by impregnating the ink holding member with ink, it is called "filling." Further, the ink in the present invention is liquid at normal temperatures which can be discharged through an ink jet head, and for example, treating liquid capable of improving the image quality of another ink and the like are allowed.

BRIEF DESCRIPTION OF THE DRAWINGS

FIG. 3A is a partially exploded plan view, FIG. 3B is a front view, FIG. 3C is a longitudinal side view, FIG. 3D is a rear view and FIG. 3E is a transverse bottom view;

FIGS. 7A, 7B and 7C are transverse plan views, and FIGS. 7A', 7B' and 7C' are longitudinal side views;

FIGS. 8A, 8B and 8C are transverse plan views, and FIGS. 8A', 8B' and 8C' are longitudinal side views;

FIGS. 9A, 9B and 9C are transverse plan views, and FIGS. 9A', 9B' and 9C' are longitudinal side views;

DETAILED DESCRIPTION OF THE PREFERRED EMBODIMENTS

First Embodiment

Hereinafter, with reference to FIGS. 1A and 1B to FIGS. 12A and 12B, the description will be made of a first embodiment according to the present invention. In this respect, the description will be made with the right-and-left direction of FIGS. 1A and 1B as the front-to-back direction of the apparatus in the following, but this is defined for the sake of convenience for simplicity, and does not limit the direction when the apparatus is actually manufactured or used.

Figure 1A:
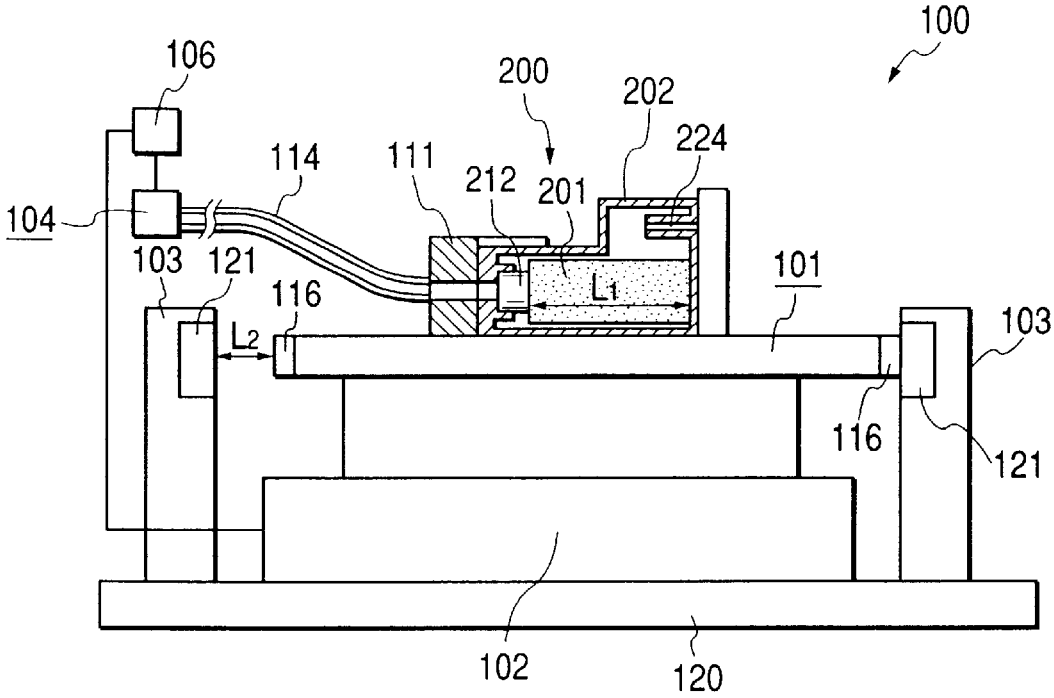
FIGS. 1A and 1B are side views showing an ink pouring device according to a first embodiment of the present invention.
Figure 1B:
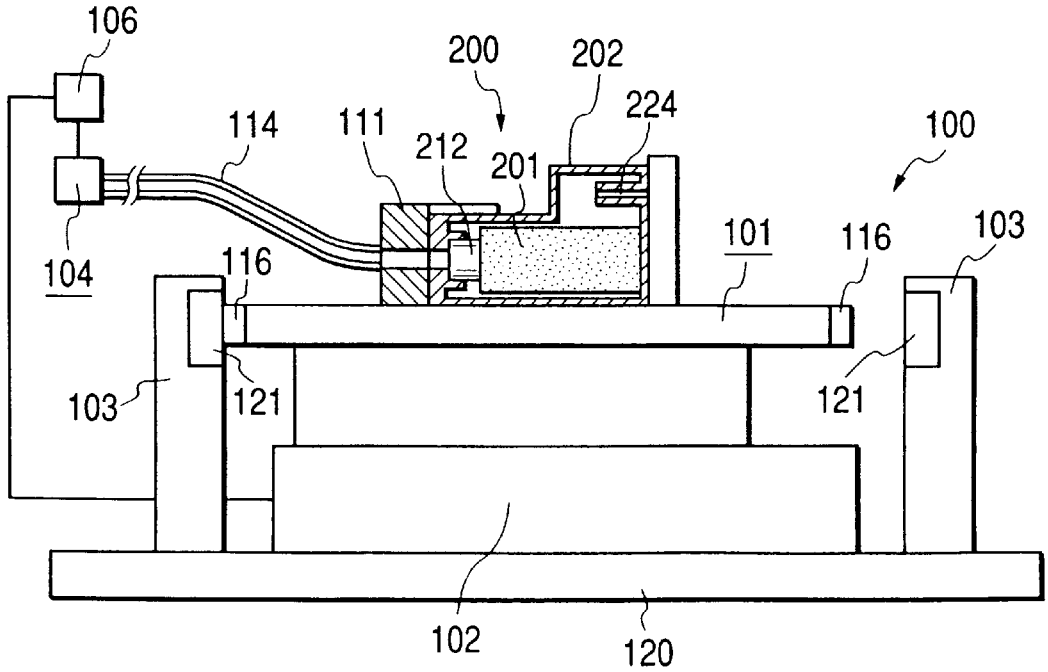
Figure 2A:
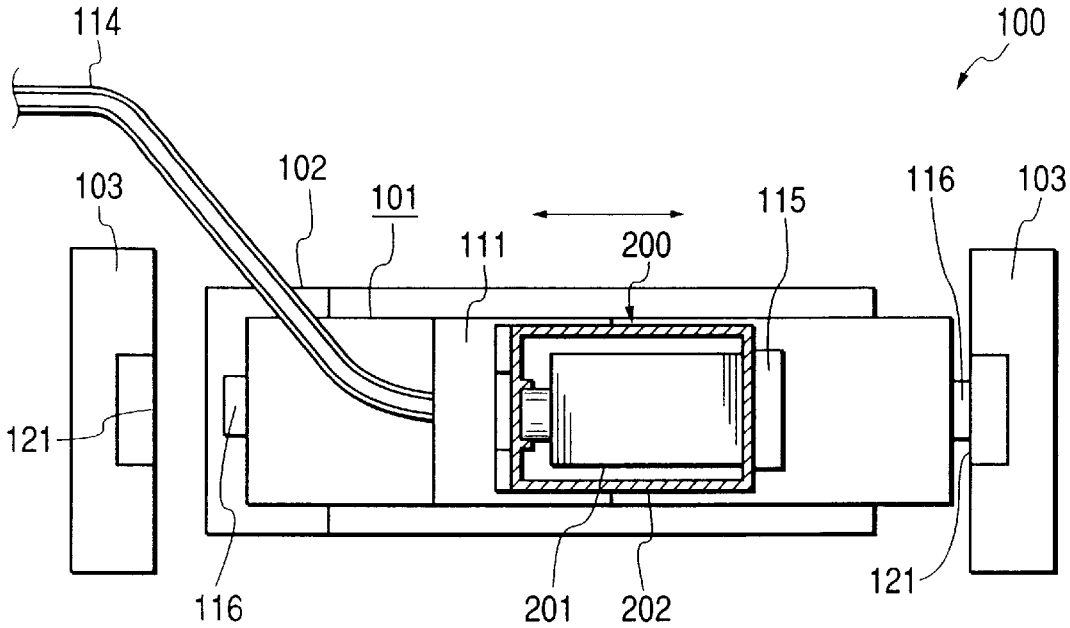
FIGS. 2A and 2B are plan views showing an ink pouring device according to the first embodiment of the present invention.
Figure 2B:
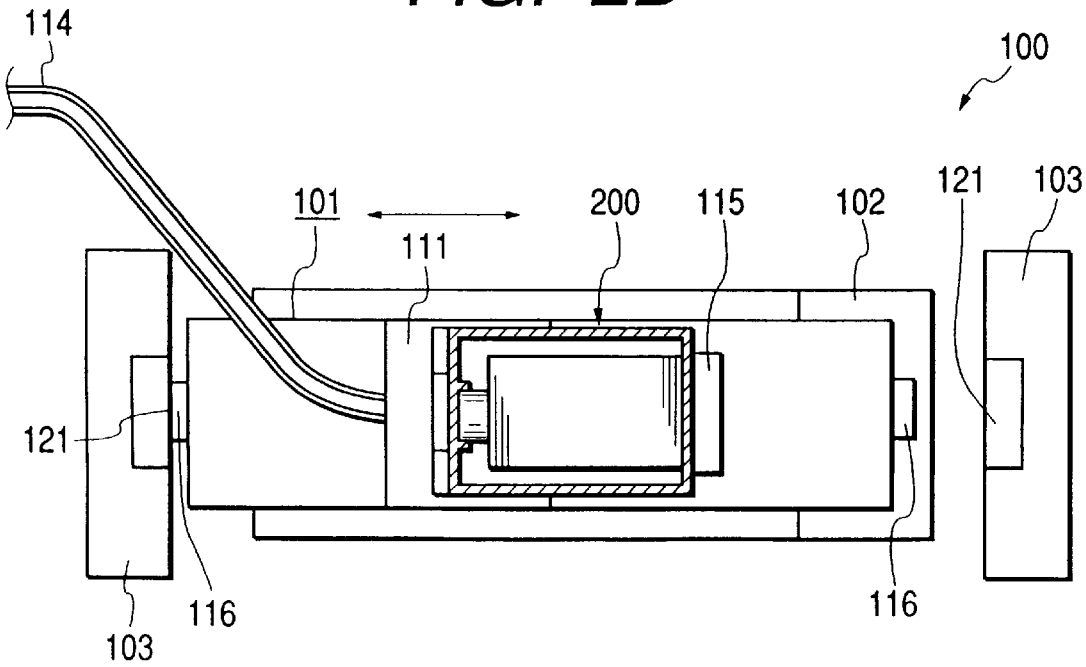
Figure 3A:
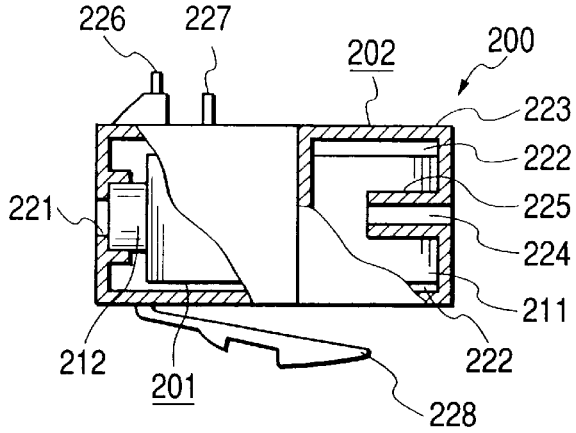
FIGS. 3A, 3B, 3C, 3D and 3E are explanatory views illustrating the structure of an ink tank according to the first embodiment of the present invention.
Figure 3B:
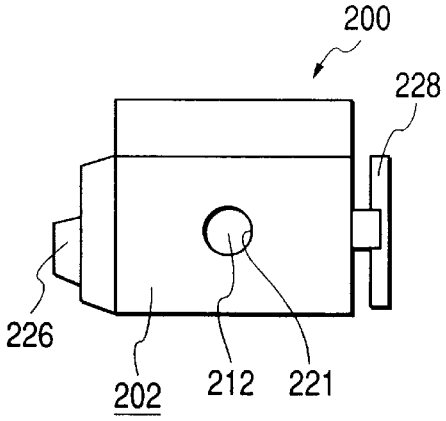
Figure 3C:
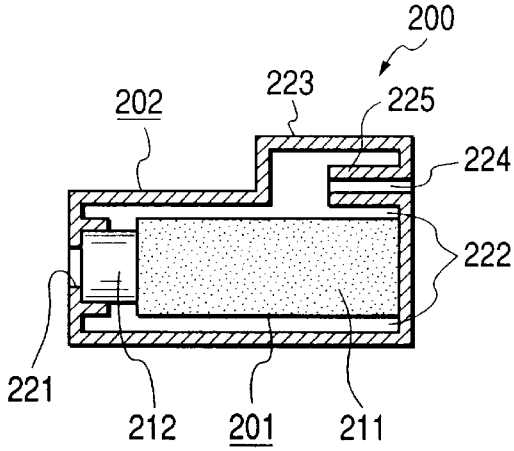
Figure 3D:
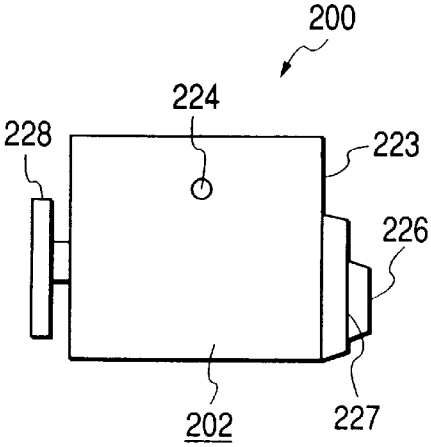
Figure 3E:
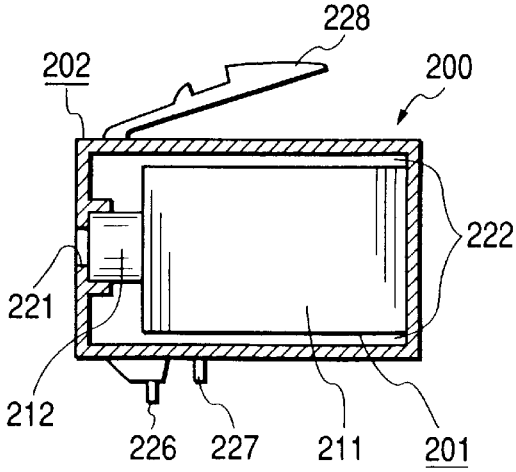

First, with reference to FIGS. 1A and 1B to FIGS. 3A to 3E, the description will be made of the structure of the ink tank 200 into which ink 1 is poured by using the ink pouring device 100 according to the present embodiment. FIGS. 1A and 1B are side views showing the ink pouring device according to the first embodiment of the present invention, FIGS. 2A and 2B are plan views showing the same, and FIGS. 3A to 3E show the structure of the ink tank: FIG. 3A is a partially exploded plan view, FIG. 3B is a front view, FIG. 3C is a longitudinal side view, FIG. 3D is a rear view and FIG. 3E is a transverse bottom view.

This ink tank 200 is detachably mounted to an ink jet printer (not shown), and is, as shown in FIGS. 3A to 3E, constructed of an ink holding member 201 for holding ink, and a tank container 202 for containing the ink holding member, and the ink holding member 201 is constructed of an absorbing member 211 for further mainly holding ink and an ink introducing member 212 provided in the vicinity of an ink supply port to be described later, for introducing the ink in the absorbing member to the outside through an ink supply port. This ink introducing member 212 is provided by urging against the absorbing member 211 to thereby improve the use efficiency of the ink in the ink tank. The ink holding member 201 consisting of the absorbing member 211 and the ink introducing member 212 holds the ink 1 to be impregnated by means of a capillary force generated among gaps between fibers.

Figure 4:
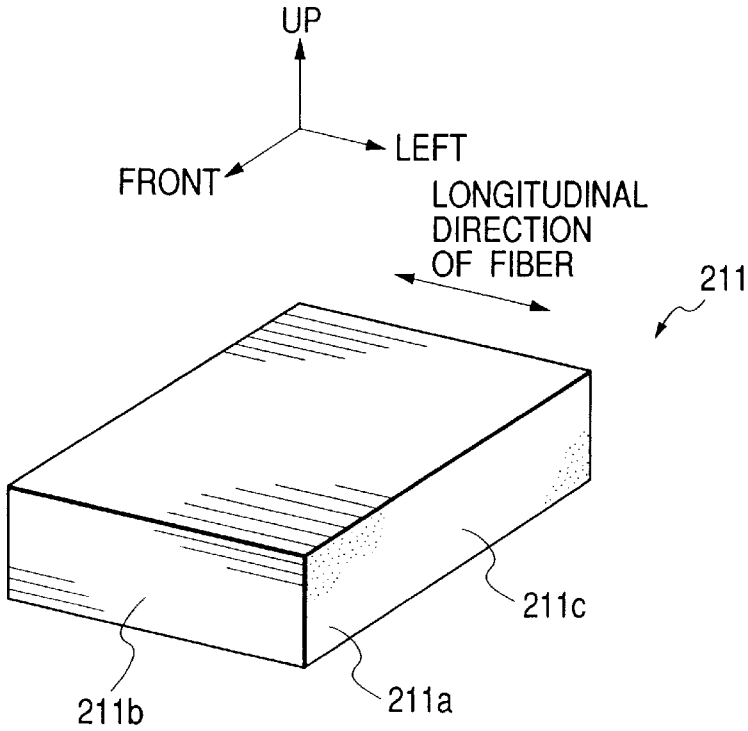
FIG. 4 is a perspective view showing an external appearance of an absorbing member to be used for the ink tank according to the first embodiment of the present invention.
Figure 5:
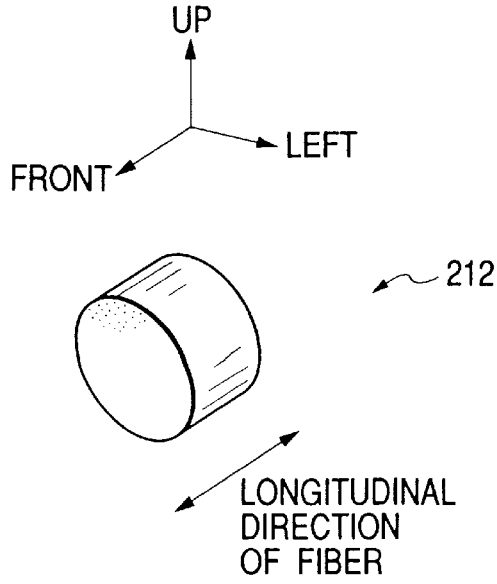
FIG. 5 is a perspective view showing an external appearance of an ink introducing member to be used for the ink tank according to the first embodiment of the present invention.

The absorbing member 211 is made of resin fibers such as polypropylene, polyester, and polyethylene terephthalate, and is, as shown in FIGS. 3A to 3E and FIG. 4, formed into a flat rectangular parallelepiped shape by a multiplicity of resin fibers focused such that its longitudinal direction becomes the right-and-left direction. The ink introducing member 212 is also made of resin fibers such as polypropylene, polyester, and polyethylene terephthalate, and is, as shown in FIGS. 3A to 3E and FIG. 5, formed into a small cylindrical column shape by a multiplicity of resin fibers focused such that its longitudinal direction becomes the front-to-back direction. FIG. 4 is a perspective view showing external appearance of an absorbing member, which is a major portion of the ink holding member, and FIG. 5 is a perspective view showing external appearance of an ink introducing member.

The absorbing member 211 and the ink introducing member 212 according to the present embodiment are made of fiber absorbent. This fiber absorbent is obtained as below: the surface layer of thread-shaped olefin resin fibers is first coated with another olefin resin whose melting point is relatively lower than that of the resin, and one thus obtained is focused at predetermined fiber density as a bunch of fibers into the fiber absorbent. The fiber absorbent can be easily formed by heating the bunch of fibers at, for example, such temperatures that the olefin resin in the surface layer melts, thereafter compressing it in a radical direction by passing it through a die having a predetermined shape, and increasing a rate at which the fibers are brought into contact with one another to thereby fusion bond the surface layer melted.

For this reason, the surface layer 211B of the absorbing member 211 has, as shown in FIG. 4, higher fiber density than its central portion 211C by the compression when the fiber absorbent is manufactured. The absorbing member 211 and the ink introducing member 212 according to the present embodiment are both formed by cutting the above described fiber absorbent in a direction substantially perpendicular to the direction of fiber, and a cut surface 211A of the absorbing member 211 is located on the side of the ink holding member 201.

In this respect, such absorbing member 211 and ink introducing member 212 as described above can also be formed by heating resin fibers focused with resin such as, for example, polyethylene as a binder or the like.

A tank container 202 is, as shown in FIGS. 3A to 3E, formed into a flat box shape made of resin, and the ink holding member 201 is arranged therein. This tank container 202 is formed with an ink supply port 221 for supplying ink 1 to the outside, and adjacent to the ink supply port 221, an ink introducing member 212 is arranged within the tank container 202. Further, inside the tank container 202, an absorbing member 211 is arranged adjacent to the ink introducing member 212, which is urged against the absorbing member 211.

As described above, the direction of fiber of the absorbing member 211 arranged inside the tank container 202 is parallel with the up-and-down direction of the figure in FIGS. 3A and 3E, and is parallel with the right-and-left direction of the figure in FIGS. 3B and 3D. On the other hand, the direction of fiber of the ink introducing member 212 is parallel with the right-and-left direction of the figure in FIGS. 3A, 3C and 3E, and is perpendicular to the direction of fiber of the absorbing member 211.

The absorbing member 211 and the tank container 202 are formed into a similar shape to each other, and the outside of the absorbing member 211 at the right, left, top or bottom opposes to the inside of the tank container 202 at the right, left, top or bottom through a predetermined gap 222 respectively.

In the upper, rear part of the tank container 202, a buffer 223 integrally protrudes, and on the rear surface of the buffer 223, there is formed an atmosphere communication port 224. This atmosphere communication port 224 is a through hole, which communicates the interior of the tank container 202 to the exterior thereof, and is opened at the center within the buffer 223 through an extension pipe 225.

At the front of the outside surface of the tank container 202 on the right side, an engaging protruded portion 226 and a fulcrum protruded portion 227 integrally protrude, and at the front thereof on the left side, an engaging lever 228 integrally protrudes. This engaging lever 228 is formed with an engaging pawl and an operating portion, which are formed in such a manner as to be freely curved in the right and left direction through elasticity.

By the above described engaging protruded portion 226, the engaging lever 228 and the like, the tank container 202 of the ink tank 200 is formed with a mounting portion, which is detachably held by a tank holding portion (not shown) of a head cartridge in an ink jet printer. In this respect, in this head cartridge, an ink feeding mechanism (not shown) is piped to the tank holding portion, and when the ink tank 200 is held at the tank holding portion, the ink feeding mechanism is coupled to the ink supply port 221 to thereby supply ink 1 to the recording head of the head cartridge from the ink tank 200.

The ink pouring device 100 according to the present embodiment for pouring ink 1 into the ink tank 200 having the above-described structure is, as shown in FIGS. 1A and 1B and FIGS. 2A and 2B, provided with a tank holding stage 101, a stage moving mechanism 102, a stopper member 103, which is a stage stop member, an ink supply mechanism 104, a control unit 106, which is operation control means, and the like as major components.

The tank holding stage 101 detachably holds the tank container 202 of the ink tank 200, the stage moving mechanism 102 reciprocates the tank holding stage 101 at a predetermined velocity in the front-to-back direction, and a pair of stopper members 103 stop the reciprocation of the tank holding stage 101 on both sides.

The ink supply mechanism 104 supplies ink 1 to the ink tank 200, and the control unit 106 controls the operations of the stage moving mechanism 102 and the ink supply mechanism 104.

More specifically, the tank holding stage 101 is formed into a horizontal flat plate shape using structural material having high rigidity such as engineering plastic, and at the front of the upper surface thereof, a tank holding portion 111 is integrally fixed. This tank holding portion 111 may be formed in the same structure as the above described tank holding portion of the head cartridge in the ink jet printer as shown in, for example, FIGS. 6A and 6B, whereby the tank container 202 in the ink tank 200 can be detachably held by an engaging recess 112 and an engaging pawl 113.

When the tank container 202 in the ink tank 200 is held by the tank holding portion 111 of the tank holding stage 101 in this manner, its atmosphere communication port 224 is positioned above the ink holding member 201 so that the longitudinal direction of the resin fibers of the ink holding member 201 becomes parallel with the right-and-right direction and is perpendicular to the moving direction of the stage moving mechanism 102.

A supply pipe 114 of the ink supply mechanism 104 is piped to the tank holding portion 111 of the tank holding stage 101, and when the ink tank 200 is mounted to the tank holding portion 111, the supply pipe 114 is coupled to the ink supply port 221.

At the rear of the tank holding portion 111, a clamping member 115 is arranged in such a manner as to be freely movable in the front-to-back direction by a guide rail (not shown), and this clamping member 115 assists holding the ink tank 200 by the tank holding portion 111 from the rear.

In this respect, in FIGS. 1A and 1B and FIGS. 2A and 2B, the clamping member 115 is schematically depicted, but the clamping member 115 according to the present embodiment does not cover the atmosphere communication port 224 of the ink tank.

The tank holding stage 101 is, as described above, formed into a horizontal flat plate shape using structural material having high rigidity, and collision members 116 are mounted to end surfaces in front of and behind it respectively. These collision members 116 are made of material free from elasticity having high rigidity such as SUS material, duralumin, titanium and ceramic, and oppose to a pair of stopper members 103 individually.

The stage moving mechanism 102 is constructed of a linear motor, an air cylinder, a guide rail and the like (not shown), to reciprocate the tank holding stage 101 at a predetermined velocity in the front-to-back direction. This stage moving mechanism 102 is fixed at the center of the upper surface of a flat plate-shaped body base 120, and a pair of stopper members 103 are vertically installed on the upper surface of this body base 120 one each in front and behind.

These pair of stopper members 103 are also made of structural material free from elasticity having high rigidity, and are firmly fixed to the body base 120. The pair of stopper members 103 are positioned one each on both sides, in front and in the rear of the tank holding stage 101, and collision members 121 made of the same material are mounted at positions where the collision member 116 of the tank holding stage 101 collides.

The tank holding stage 101, which is reciprocated by the stage moving mechanism 102 as described above, is alternately stopped at both ends by collision of the stopper member 103, whereby an inertial force is alternately imparted to ink 1 within the ink tank 200 in the front-to-back direction.

The inertial force to be imparted to the ink 1 here is generated in a very short time by causing the tank holding station 101, which moves at a predetermined velocity, to collide with the stopper member 103 for abruptly stopping, and is far greater than an inertial force to be imparted to the ink 1 until the tank holding stage 101 at rest has a predetermined velocity.

Its magnitude is sufficiently greater than a sum of a static holding force when the ink holding member 201 such as meniscus holds the ink 1, and a dynamic resistant force such as sliding resistance which occurs when the ink 1 moves.

The ink supply mechanism 104 is provided with a large-capacity tank, a pressure feed pump, a magnet-valve and the like (not shown), and pressurizes the ink 1 to predetermined pressure to supply it to the ink supply port 221 of the tank container 202 in the ink tank 200 through the supply pipe 114 piped to the tank holding portion 111.

The control unit 106 includes a so-called computer system, and controls the operations of the stage moving mechanism 102 and the ink supply mechanism 104 in accordance with a control program packaged in advance. In the present embodiment, when the ink 1 is supplied to the ink tank 200 from the ink supply mechanism 104, the tank holding stage 101 holding the ink tank 200 is caused to reciprocate on the stage moving mechanism 102 at the same time to impart an inertial force to the ink 1 to be poured.

Thereafter, the supply of the ink 1 by the ink supply mechanism 104 is stopped when a predetermined amount is supplied, and with this stoppage, the ink supply mechanism 104 is caused to close the ink supply port 221 of the ink tank 200. In this manner, the stage moving mechanism 102 is caused to continuously reciprocate even if the supply of the ink 1 by the ink supply mechanism 104 is stopped, and this reciprocation is stopped after executed for the predetermined duration.

Figure 7A:
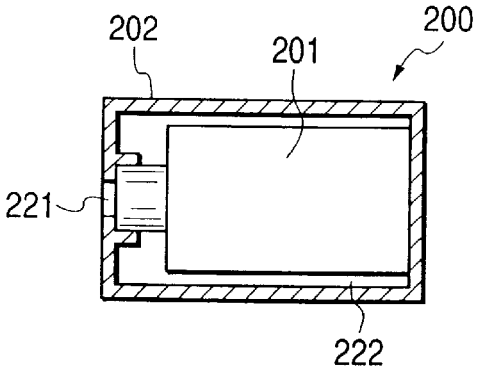
FIGS. 7A, 7B and 7C and FIGS. 7A', 7B' and 7C' show a first half of a process of the absorbing member in the ink tank being impregnated with ink by an inertial force.
Figure 7A:
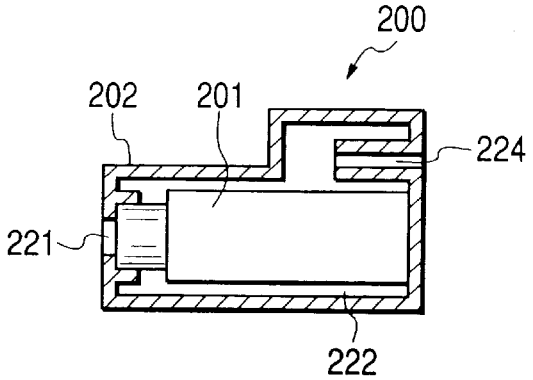
Figure 7B:
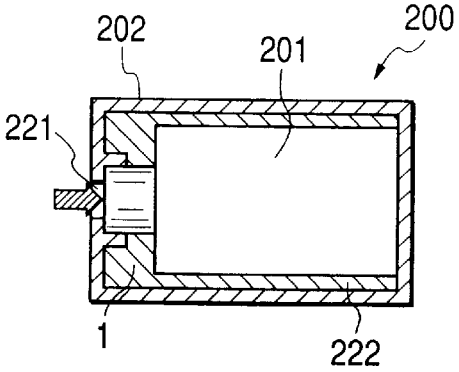
Figure 7B:
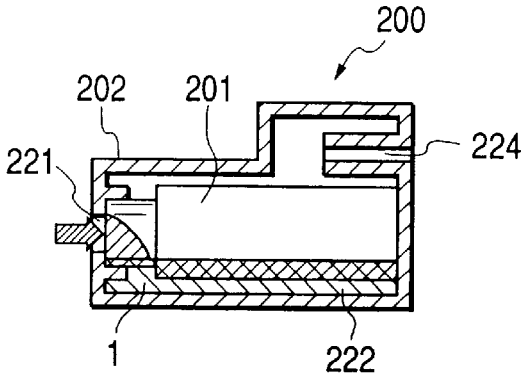
Figure 7C:
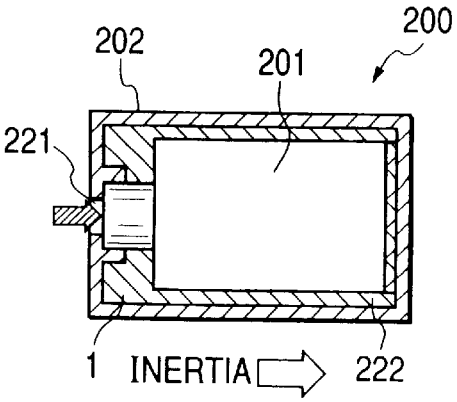
Figure 7C:
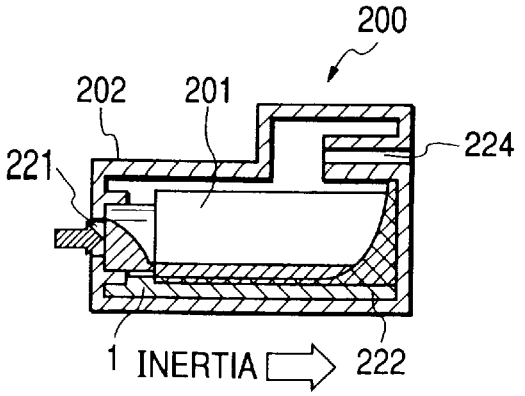
Figure 8A:
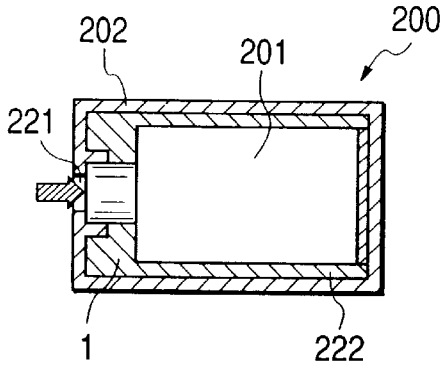
FIGS. 8A, 8B and 8C and FIGS. 8A', 8B' and 8C' show an intermediate of a process of the absorbing member in the ink tank being impregnated with ink by an inertial force.
Figure 8A:
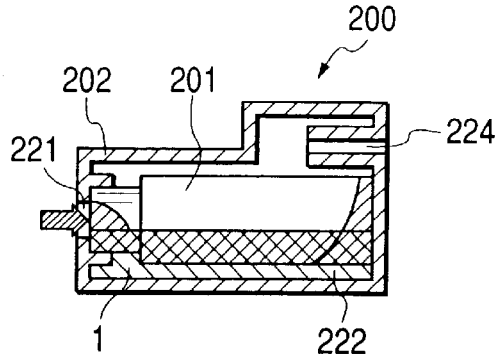
Figure 8B:
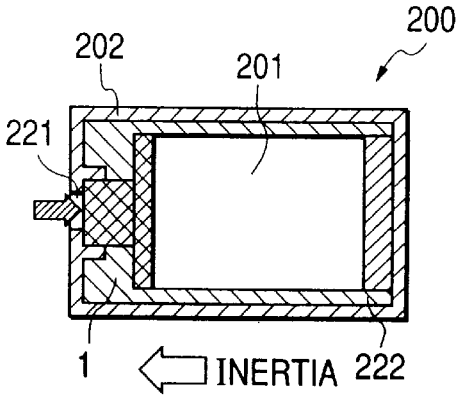
Figure 8B:
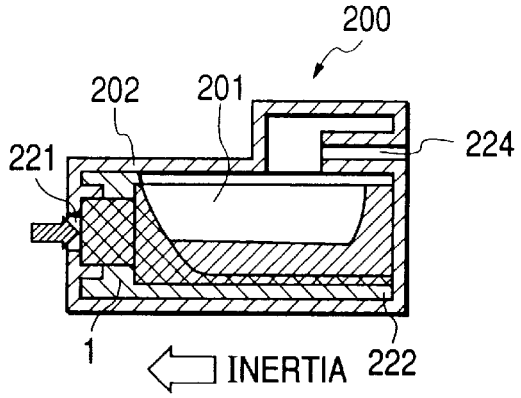
Figure 8C:
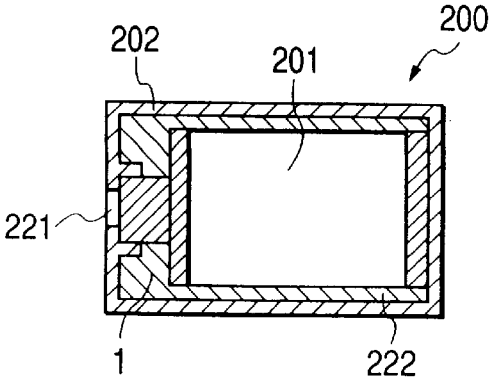
Figure 8C:
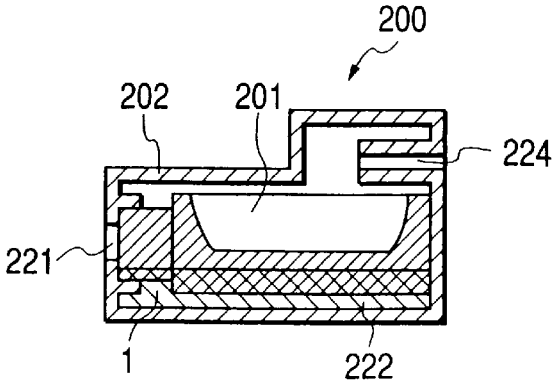
Figure 9A:
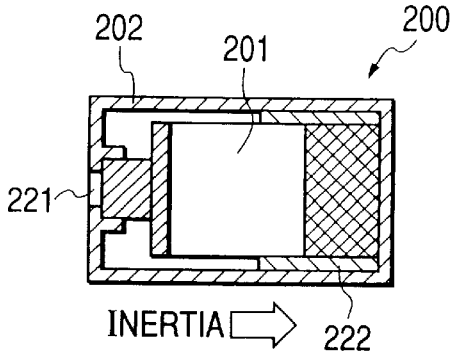
FIGS. 9A, 9B and 9C and FIGS. 9A', 9B' and 9C' show a second half of a process of the absorbing member in the ink tank being impregnated with ink by an inertial force.
Figure 9A:
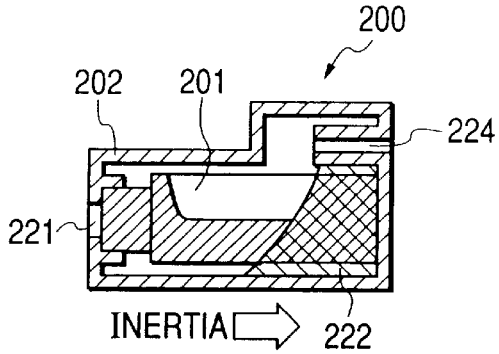
Figure 9B:
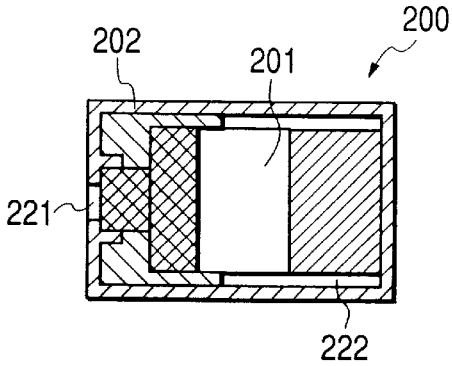
Figure 9B:
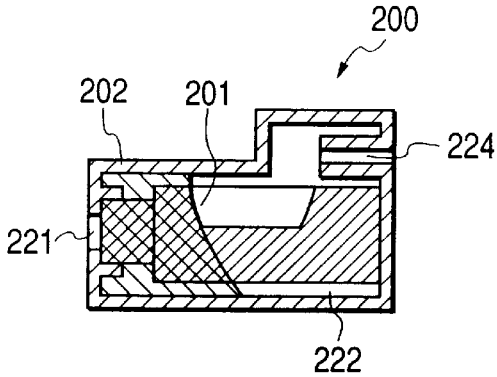
Figure 9C:
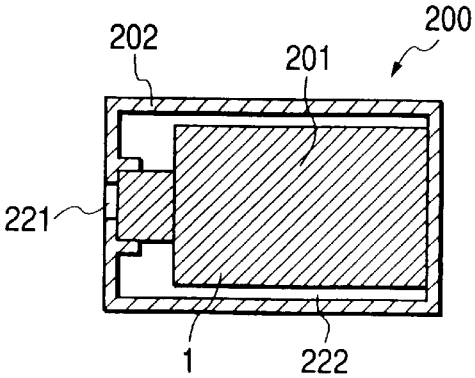
Figure 9C:
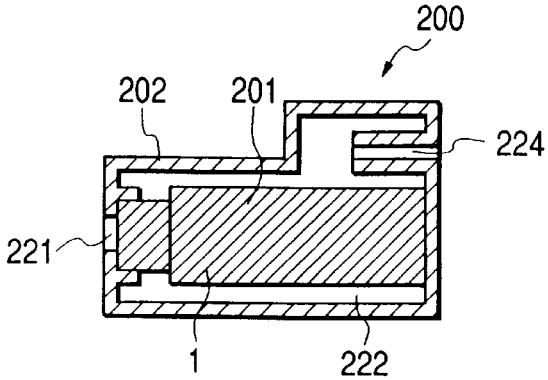

In such configuration as described above, with reference to FIGS. 7A to 7C and 7A' to 7C' to FIG. 10, the description will be made of an operation of pouring the ink 1 into the ink tank 200 using the ink pouring device 100 according to the present embodiment hereinafter. FIGS. 7A to 7C and 7A' to 7C' show a first half of a process of the absorbing member in the ink tank being impregnated with ink by an inertial force: FIGS. 7A to 7C are transverse plan views, and FIGS. 7A' to 7C' are longitudinal side views. FIGS. 8A to 8C and 8A' to 8C' show the intermediate of the process: FIGS. 8A to 8C are transverse plan views, and FIGS. 8A' to 8C' are longitudinal side views. FIGS. 9A to 9C and 9A' to 9C' show a second half of the process: FIGS. 9A to 9C are transverse plan views, and FIGS. 9A' to 9C' are longitudinal side views.

Figure 10:
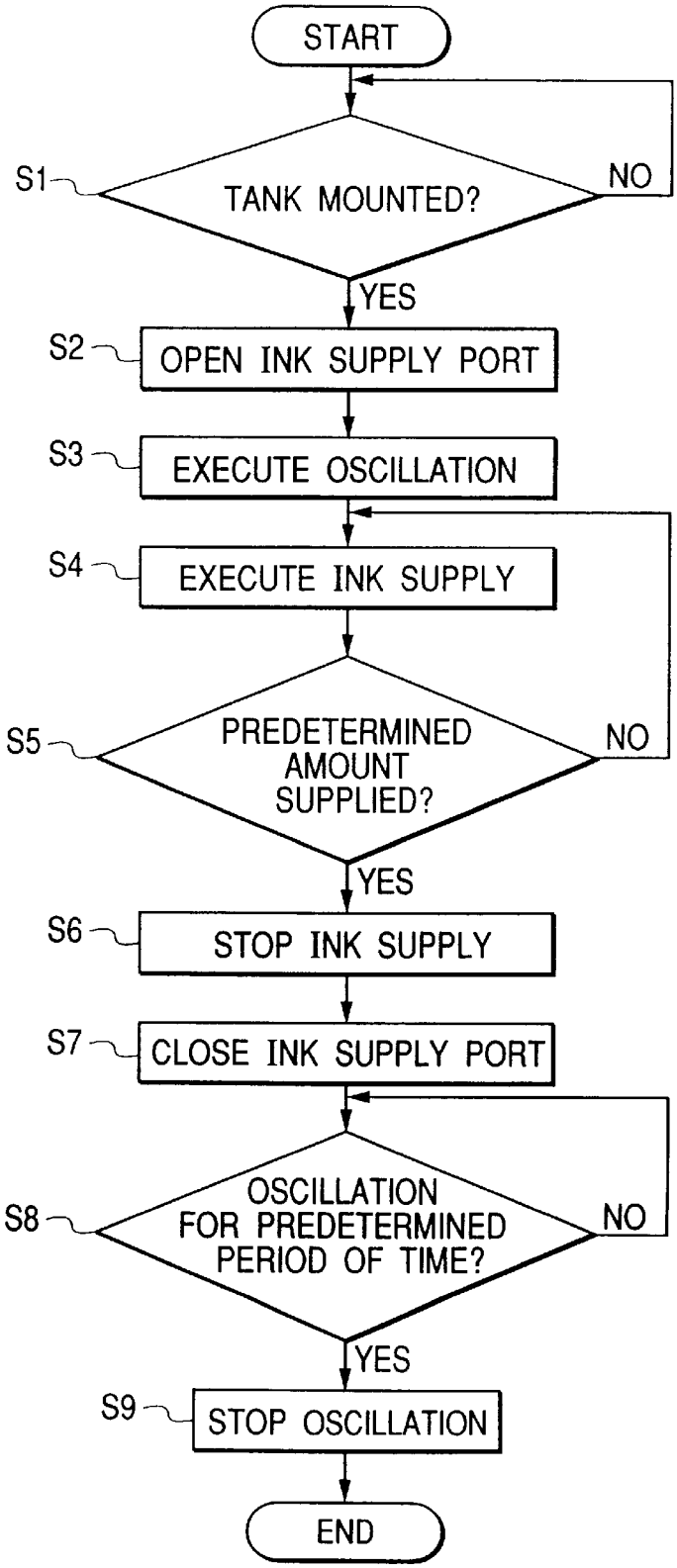
FIG. 10 is a flow chart showing an ink filling method using the ink pouring device according to the first embodiment of the present invention.
Figure 11:
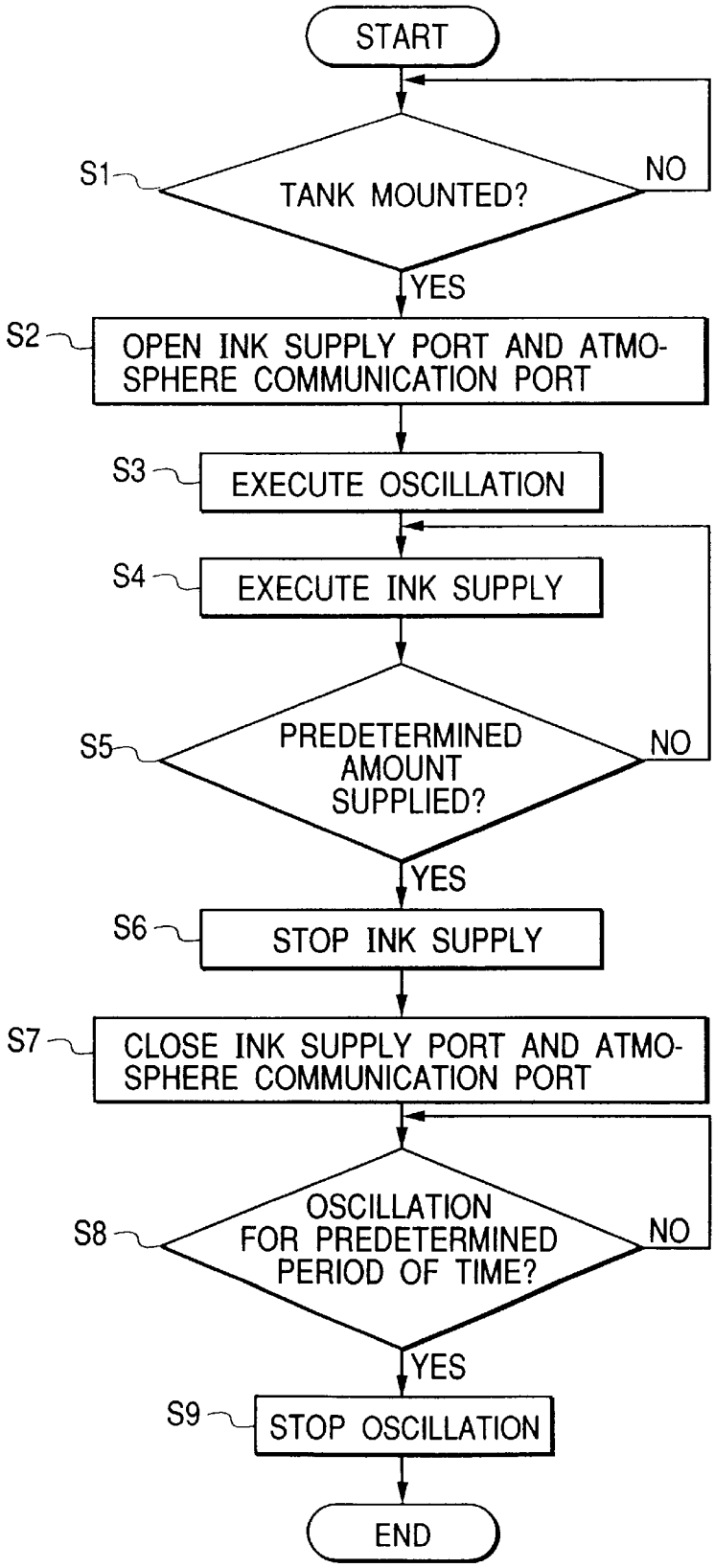
FIG. 11 is a flow chart showing an ink filling method according to a modification of the first embodiment of the present invention.

FIG. 10 is a flow chart showing an ink filling method using the ink pouring device. In FIGS. 7A to 7C and 7A' to 7C' to 9A to 9C and 9A' to 9C', the staying ink 1 is represented by right-descending hatching, and the ink 1, with which the ink holding member 201 is impregnated, is represented by right-ascending hatching.

The atmosphere communication port 224 is positioned above the ink holding member 201, and the ink tank 200 is mounted onto the tank holding stage 101 in such a manner that the longitudinal direction of the resin fiber in the ink holding member 201 becomes parallel with the right-and-left direction.

At this time, the supply pipe 114 of the ink supply mechanism 104 is coupled to the ink supply port 221, but the magnet-valve of the ink supply mechanism 104 is closed. On the other hand, the rear surface of the ink tank 200 is held by the clamping member 115, but the atmosphere communication port 224 of the ink tank 200 is opened.

When the mounting of the ink tank 200 is completed in this manner, a control unit 106 is notified of this by, for example, a removal sensor (not shown), and therefore, the ink pouring device 100 is ready to execute a pouring operation of the ink 1 as shown in FIGS. 7A and 7A' and FIG. 10 (Step S1).

Thus, the operation control of the control unit 106 opens the magnet-valve of the ink supply mechanism 104 (Step S2), and reciprocation of the tank holding stage 101 is started by the stage moving mechanism 102 (Step S3). Since this tank holding stage 101, which is reciprocating, alternately collides with the stopper members 103 on both sides, this repeatedly imparts an abrupt inertial force, whose direction is alternately reversed, to the ink tank 200.

Since the supply of the ink 1 is started by the ink supply mechanism 104 in such a state (Step S4), the ink 1 is to be supplied to the ink tank 200, to which the abrupt inertial force, whose direction is alternately reversed as described above, is repeatedly imparted.

At this time, when an attempt is made to pour the ink 1 into the ink holding member 201 from the ink supply port 221 of the ink tank 200 simply under pressure, the ink 1 is going to preferentially flow to points having smaller flow resistance in the ink holding member 201 because the ink holding member 201 has a large contact angle with the ink 1 and displays hydrophobic nature.

For the reason, when the ink 1 flows out from the outer peripheral surface of the ink holding member 201 before the ink 1 spreads all over every part of the ink holding member 201, the ink 1 continuously flows out between the tank inner walls and the outer peripheral surface of the ink holding member 201 without passing through portions having greater flow resistance in the ink holding member 201 thereafter.

In the present embodiment, there are cases where as shown in FIGS. 7B' and 7C' and FIGS. 8A and 8B, the ink 1 to be poured while the tank holding stage 101 does not collide with the stopper member 103 may stay in a gap 222 between the tank container 202 and the ink holding member 201 without impregnating the ink holding member 201 for the above described reason.

In case of the ink pouring device 100 according to the present embodiment, however, the abrupt inertial force, whose direction is alternately reversed, is repeatedly imparted to the ink 1 within the ink tank 200. In this case, the ink 1, to which a greater inertial force greater than a sum of a static ink holding force of the ink holding member 201 and a dynamic resistant force of the ink 1 has been imparted, is capable of moving within the ink holding member 201 in the reciprocating direction of the ink pouring device 100 without depending upon the flow resistance of the ink holding member 201. Particularly, in FIGS. 7C and 7C', the pouring direction of the ink 1 coincides with the direction of the inertial force, and therefore, the ink 1 to be poured is capable of moving within the ink holding member 201 in the direction of the inertial force.

In the present embodiment, even if the ink 1 stays in the gap 222, a similar inertial force is imparted even to the ink 1 which has stayed, and therefore, the ink 1, which has stayed in the gap 222, also moves in the direction of the inertial force by the inertial force imparted as shown in FIGS. 7C and 7C' and FIGS. 8B and 8B'. As a result, each portion of the outer surface of the ink holding member 201 is to be successively impregnated with the ink 1.

In this respect, in the present embodiment, each surface constituting the outer surfaces of the absorbing member 211 is a cut surface 211A or a surface having a surface layer portion 211B as described in FIG. 4. Since the surface layer portion 211B has higher fiber density and a greater static ink holding force than the central portion 211C, there can be imparted, to the ink 1, a greater inertial force than a sum of the static ink holding force in the surface layer portion 211B and the dynamic resistant force of the ink 1 in the case where the ink 1 is poured into the ink tank 200 having such an absorbing member 211.

Since the atmosphere communication port 224 is opened when the ink 1 is supplied to the ink tank 200 as described above, the ink 1 is smoothly flowed under pressure, and since the atmosphere communication port 224 is opened at the tip end of the extension pipe 225 above the ink holding member 201, the ink 1, which is agitated inside the tank container 202, does not leak to the outside from the atmosphere communication port 224.

When the ink 1 to be supplied to the ink tank 200 as described above reaches a predetermined capacity within predetermined duration as shown in FIGS. 8C and 8C' (Step S5), the supply of the ink 1 by this ink supply mechanism 104 is stopped (Step S6), and the ink supply port 221 of the ink tank 200 is closed (Step S7).

In case of the present embodiment, even if the supply of the ink 1 by the ink supply mechanism 104 is stopped as described above, the reciprocation of the stage moving mechanism 102 is continued for the predetermined duration (Step S8, S9), and therefore, impregnation of the ink holding member 201 with the ink 1 by the impartation of the inertial force is also continued, and as shown in FIGS. 9A, 9A', 9B and 9B', almost all of the ink holding member 201 is impregnated with almost all of the ink 1, which has stayed in the gap 222 within the tank container 202.

In the ink pouring device 100 according to the present embodiment, an greater inertial force than a sum of the static ink holding force and the dynamic resistant force is repeatedly imparted to the ink 1, with which the ink holding member 201 has been impregnated as described above, in such a manner that its direction is alternately reversed and therefore, the ink holding member 201 can be quickly impregnated with the ink 1 irrespective of the hydrophobic nature and the hydrophilic nature.

In particular, in the ink pouring device 100 according to the present embodiment, the tank holding stage 101, which is repeatedly reciprocated by the stage moving mechanism 102, is caused to stop on both sides by collision of the pair of stopper member 103, and therefore, a great inertial force can be favorably imparted to the ink 1 in a minute time in simple structure, and almost all of the ink holding member 201 can be quickly impregnated with the ink 1.

Further, since the longitudinal direction of the resin fibers focused as the ink holding member 201 and the direction of the inertial force generated by the ink pouring device 100 intersect each other, the ink 1 is prone to be dispersed in a multiplicity of gaps of resin fibers in the ink holding member 201 by the inertial force imparted, and the entire ink holding member 201 can be favorably impregnated with the ink 1.

Also, since the control unit 106 executes the supply of the ink 1 by the ink supply mechanism 104 and the reciprocation by the stage moving mechanism 102 at the same time, the ink holding member 201 can be successively impregnated with the ink 1 to be successively supplied to the ink tank 200.

At this time, even if the ink 1 poured into the ink tank 200 stays in a gap 222 between the inner surface of the tank container 202 and the outer surface of the ink holding member 201, the inertial force is continuously imparted to the ink tank 200 even after the completion of the supply of the ink 1, and therefore, the entire ink holding member 201 can be favorably impregnated with the ink 1, which has stayed in the gap 222.

Further, since the atmosphere communication port 224 is opened when the ink 1 is supplied to the ink tank 200, the supply of the ink 1 can be smoothly executed. When the tank container 202 of the ink tank 200 is held by the tank holding stage 101 at this time, the atmosphere communication port 224 of the tank container 202 is positioned above the ink holding member 201, and therefore, the ink 1 to be supplied to the ink tank 200 can be prevented from leaking to the outside from the atmosphere communication port 224.

Since the ink supply port 221 is closed by the ink supply mechanism 104 at the completion of the supply of the ink 1, the ink 1 poured into the ink tank 200 can be also prevented from flowing backward from the ink supply port 221 to the outside.

Further, as an ink pouring opening in the ink tank 200, the ink supply port 211 is utilized, whereby an ink holding member 201 in the vicinity of the ink supply port 211, which serves as a combination portion in the ink supply course to the ink jet recording head when the ink tank 200 is used, can be reliably filled with ink 1. Therefore, the ink 1 poured can be effectively utilized.

Figure 6A:
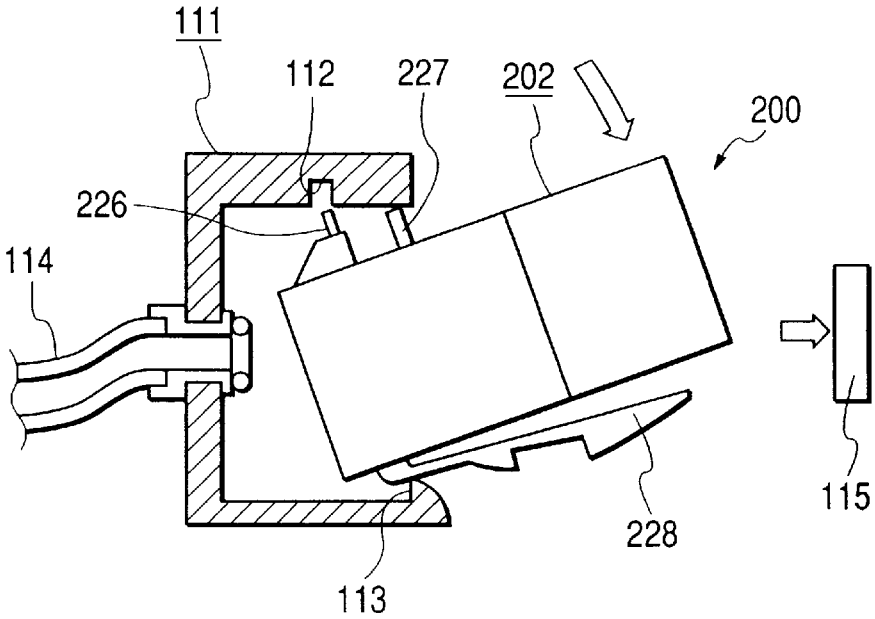
FIGS. 6A and 6B are partially exploded plan views showing a process of mounting the ink tank to a tank holding stage in the ink pouring device according to the first embodiment of the present invention.
Figure 6B:
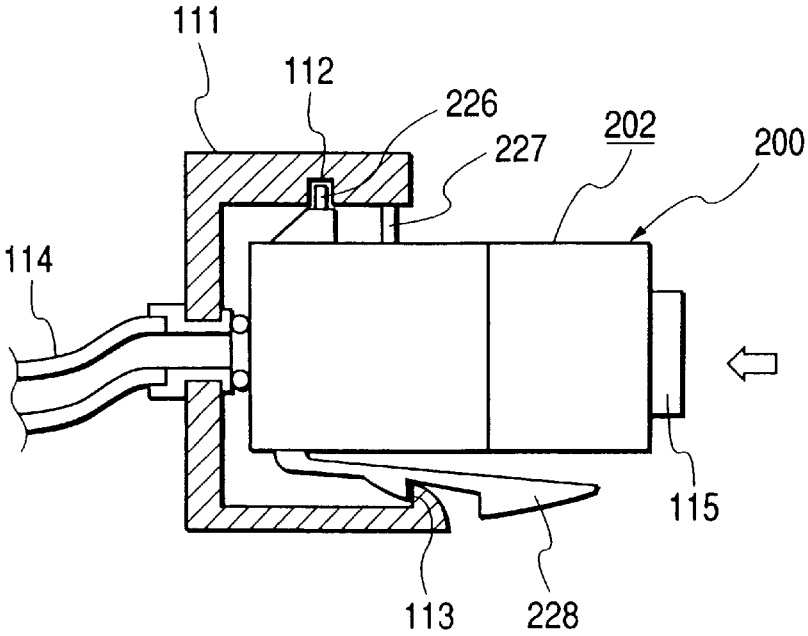

As shown in FIGS. 6A and 6B, a tank holding portion of a head cartridge in an ink jet printer, to which the ink tank 200 is to be mounted, can also be diverted to the tank holding stage 101. In this case, the ink tank 200 can be reliably held in the ink pouring device 100 by a simple mounting mechanism.

In this respect, in a modification of the present embodiment shown in FIGS. 6A and 6B, an exhaust valve (not shown) is provided for a clamping member 115 as a ventilation operating mechanism, and the atmosphere communication port 224 of the ink tank 200 can be also opened/closed by controlling by the above described control unit 106. In the case where the exhaust valve 105 is thus provided, when the ink supply port 221 of the ink tank 200 is opened/closed by the magnet-valve of the ink supply mechanism 104 as described above (Step S2, 7), the atmosphere communication port 224 of the ink tank 200 is preferably opened/closed by the exhaust valve at the same time as in the case of the flow chart for ink filling method of a modification shown in FIG. 11.

In this case, while the reciprocation of the tank holding stage 101 is being continued after pouring of a predetermined amount of the ink is completed, the ink, which stays in the gap 222 through the atmosphere communication port 224, can be prevented more effectively from flowing out to the outside before it is held by the ink holding member 201 because the atmosphere communication port 224 is closed. This method is particularly effective when the ink tank cannot be arranged on the tank holding stage because of the shape of the ink tank in such a manner that the atmosphere communication port 224 is located above the ink supply port as shown in FIGS. 3A to 3E.

In the above described embodiment, it has been exemplified that the inertial force to be imparted to the ink tank 200 is controlled by the control unit 106 with operating time of the stage moving mechanism 102, but it is also possible to control it with the number of times of reciprocation of the stage moving mechanism 102.

In this respect, when the present inventor actually trial manufactured such ink pouring device 100 and ink tank 200 as described above, it was confirmed that the ink pouring device 100 is capable of quickly pouring the ink 1 to the ink tank 200. A laser displacement meter (not shown) was mounted onto the stopper member 103 of the ink pouring device 100 to measure the distance between the tank holding stage 101 and the ink pouring device 100, and the result is shown in FIGS. 12A and 12B, which are time charts showing the moving operation of the tank holding stage.

Figure 12A:
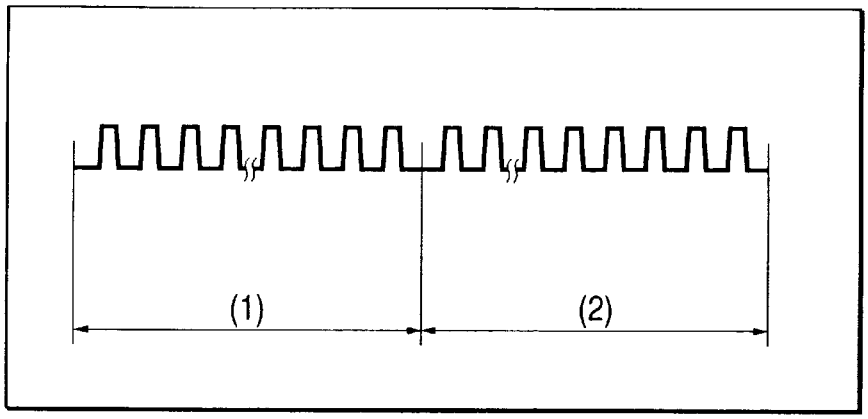
FIGS. 12A and 12B are time charts showing a moving operation of the tank holding stage.
Figure 12B:
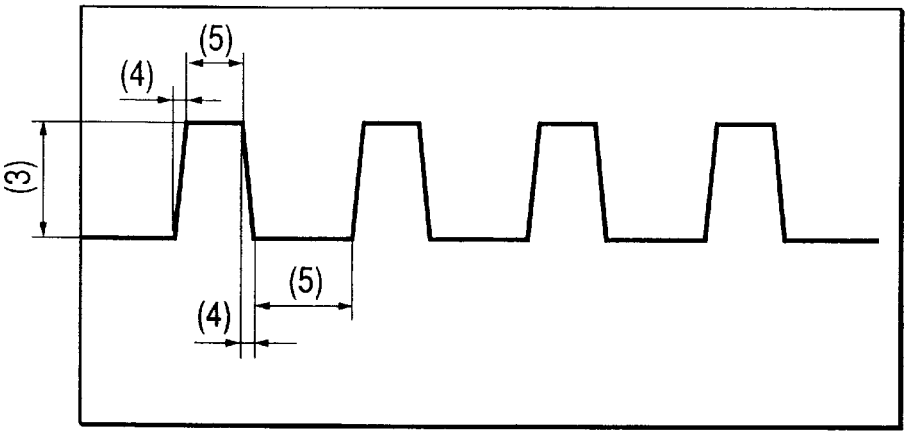

In this respect, in FIGS. 12A and 12B, the vertical axis indicates distance, and the horizontal axis indicates time. (1) in FIG. 12A shows a state in which the ink pouring device 100 executes the supply of ink and the impartation of the inertial force at the same time, and (2) shows a state in which the supply of ink is stopped and only the impartation of the inertial force is continued.

As regards duration (1) during which the inertial force is imparted to the ink 1 while the ink is being poured, and duration (2) during which the inertial force is imparted to the ink 1 after it is poured, these duration is preferably set to be optimum in accordance with the magnitude and fiber density of the ink holding member 201, into which the ink 1 is poured, type of the ink 1 to be poured and the like.

In the present embodiment, when ink of 16 g is poured into an ink tank having a representative dimension $L_1$ (FIG. 1A) of 25.5 mm, a volume of about 20 $cm^3$, and fiber diameter of the ink holding member 201 of 6 denier, (1) is set to 40 seconds and (2) is set to 20 seconds, and when ink of 16 g is poured into an ink tank having a representative dimension L1 (FIG. 1A) of 26.3 mm, a volume of about 6.2 $cm^3$, and fiber diameter of the ink holding member of 6 denier, (1) is set to 20 seconds and (2) is set to 10 seconds. In these cases, the ink could be reliably poured into the ink holding member respectively.

As shown in FIG. 12B, a wave height (3) in the graph is the maximum distance between the stopper member 103 and the tank holding stage 101, being 10 (mm), (4) designates duration during which the tank holding stage 101 moves until it collides with the stopper member 103, being 10 (μs), and (5) designates duration during which the tank holding stage 101, which collides with the stopper member 103, stops, being 40 (μs).

In this case, the moving velocity of the tank holding stage 101 immediately before the collision is 0.4 (m/sec), and this instantaneously becomes "0", whereby a necessary inertial force is imparted to the ink.

In the ink pouring device 100 trial manufactured as described above, it could be confirmed that the entire ink holding member 201 having hydrophobic nature in the ink tank 200 can be quickly impregnated with the ink 1 and that the ink 1 poured into the ink tank 200 does not leak from the atmosphere communication port 224.

Figure 13:
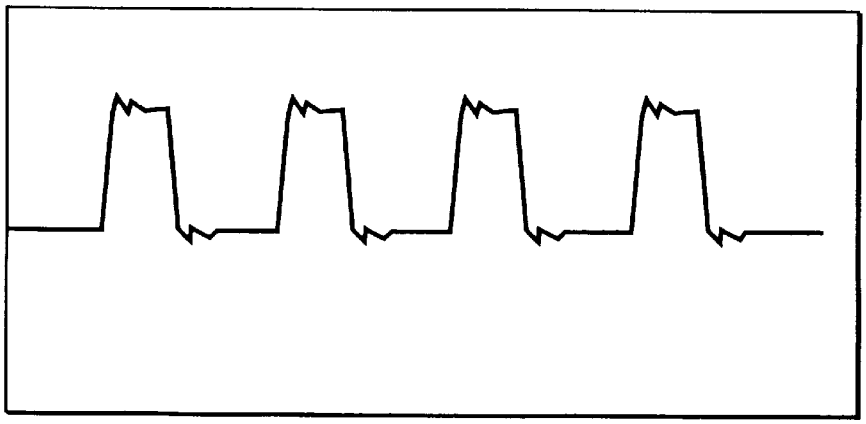
FIG. 13 is a time chart showing a moving operation of the tank holding stage according to another modification of the first embodiment of the present invention.

In this respect, in the above described ink pouring device 100, the collision members 116 and 121 between the tank holding stage 101 and the stopper member 103 were formed of the same metal, but when they are formed of different metals, spike-shaped waveforms were found in the graph as shown in FIG. 13.

This means that one having lower rigidity is deformed due to the collision, and since the impact is absorbed, the inertial force to be imparted to the ink tank 200 is to lower. More specifically, in order to generate an inertial force enough to save the electric power in simple structure, it is preferable to form the collision members 116 and 121 between the tank holding stage 101 and the stopper member 103 of the same metal, and even any different metal can be used so long as a sufficient inertial force is generated.

Second Embodiment

Next, hereinafter, with reference to FIGS. 14A, 14B and 14C and FIG. 15, the description will be made of a second embodiment according to the present invention. In the present embodiment, an ink tank 300 has three ink contain chambers capable of containing respectively different ink (for example, Y (Yellow), M (Magenta), C (Cyan) and the like).

Each of these ink contain chambers is provided with an ink supply port 321*a*, 321*b* or 321*c*, and an atmosphere communication port 324*a*, 324*b* or 324*c* respectively. An ink holding member 301*a*, 301*b* or 301*c* to be contained in each of the ink contain chambers is, as i n th e case of the first embodiment, formed into a flat rectangular parallelepiped shape by a multiplicity of resin fibers focused such that its direction of fiber becomes the direction shown in FIG. 14C.

In the present embodiment, when causing the tank holding stage 101 to hold the ink tank 300, an ink supply pipe 114*a*, 114*b* or 114*c* is connected to an ink supply port 321*a*, 321*b* or 321*c* respectively, whereby ink is poured into each of the ink holding members 301*a*, 301*b* or 301*c* contained in three ink contain chambers at the same time.

Each of the ink holding members 301*a*, 301*b* or 301*c* has a representative dimension L1 (FIG. 1A) of 26.3 mm, a volume of about 4.7 $cm^3$, and fiber diameter of about 6 denier. An amount of the ink to be poured is 3.5 g, and in FIG. 12A, (1) is set to 9 seconds, and (2) is set to 10 seconds.

Figure 14C:
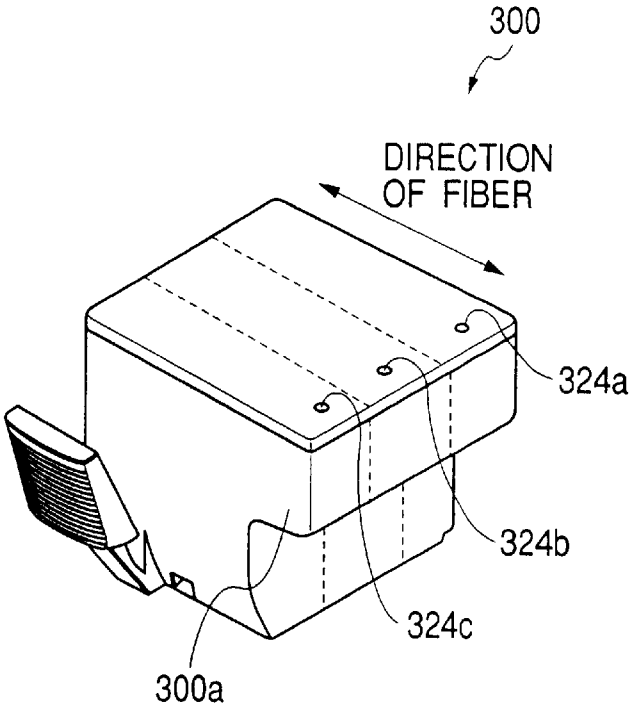
FIGS. 14A, 14B and 14C are external appearance views showing an ink tank according to a second embodiment of the present invention.
Figure 14B:
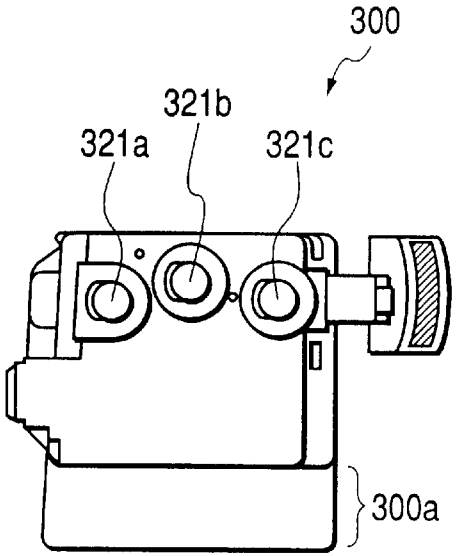
Figure 14A:
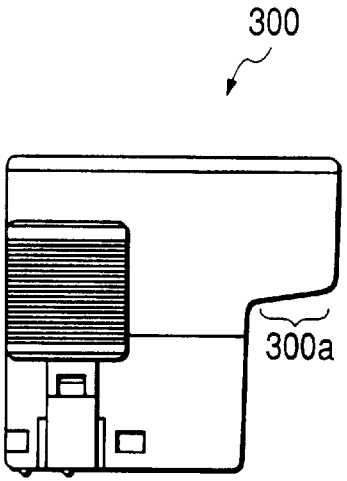

As shown in FIGS. 14A and 14C, the ink tank 300 has a protruded portion 300*a* protruding sideways, and the interior of the protruded portion 300*a* is space, in which the ink holding members 301*a*, 301*b* and 301*c* are not present. Atmosphere communication ports 324*a*, 324*b* and 324*c* are provided on the ceiling surface of the ink tank 300 at a position corresponding to this protruded portion 300*a*. Of side walls of the ink tank 300, a side wall 300*b* opposing to a side wall, on which the protruded portion 300*a* is provided, is a flat surface, and when the tank holding stage 101 is caused to hold the ink tank 300, it is held with this side wall 300*b* as the underside.

Therefore, the direction of fiber of the ink holding member according to the present embodiment is a direction substantially perpendicular to the figure of FIG. 14C, and the direction of fiber intersects the ink pouring direction even in the present embodiment although different from the first embodiment (similarly, the direction of fiber is a direction parallel with the figure in the sections shown in FIGS. 2A and 2B). As a result, even in the present embodiment, as in the case of the first embodiment, the ink imparted with the inertial force is prone to be dispersed in gaps of the fibers when it is moving within the ink holding members 301*a*, 301*b* and 301*c*.

Other Embodiments

In this respect, the present invention is not limited to the above described embodiments, but allows various modifications without departing from the gist of the invention. For example, in the above described embodiment, it has been exemplified that the ink holding member 201 is made of resin fibers focused in a fixed direction, but it is also possible to utilize conventional expanded polyurethane or the like as the ink holding member.

Although it has been exemplified that resin fibers are focused in a fixed direction to form the ink holding member 201, it is also possible to form an ink holding member free from directional property by laminating, for example, sheets knitted of resin fibers for stamping out. Also, it has been exemplified that the ink holding member 201 is made of the absorbing member 211 and the ink introducing member 212, but it is also possible to omit, for example, the ink introducing member 212.

As regards an ink holding member, which is filled with ink by the ink filling method according to the present invention, the ink holding member itself may be hydrophilicized before the ink is filled. In this case, it is preferable that the function of hydrophilic nature can be exhibited at least in the ink filling process although not sufficient in long-term durability, and when the filled ink is used, the printing characteristic is more preferably not adversely affected. As such a concrete method for hydrophilicizing, there is a method to mix a surface-active agent in, for example, a hydrophilicizing agent for impregnating the ink holding member with this solution. Such an ink holding member hydrophilicizing process is performed before an ink filling process using the ink filling method according to the present invention, whereby it becomes possible to fill the ink holding member with a desired amount of ink more quickly and reliably.

Figure 18:
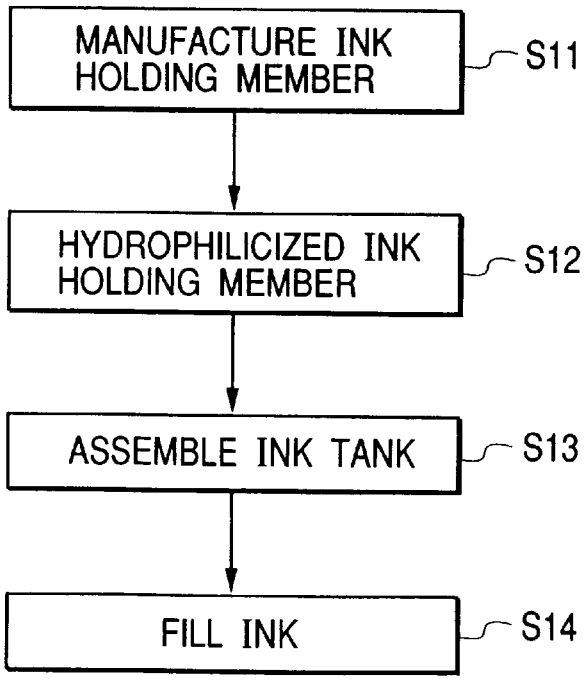
FIG. 18 is a flow chart showing an ink filling method according to the modification of the present invention.

FIG. 18 is a flow chart for explaining an example of a method for manufacturing an ink tank according to a modification of the present invention described above. In case of the present modification, after the ink holding member manufacturing process S11, there is performed an ink holding member hydrophilicizing process S12 in which the ink holding member is impregnated with the above described solution before an ink tank assembling process S13 for housing the ink tank within the housing. Thus, after the ink tank assembling process S13 for housing the ink holding member hydrophilicized into the tank housing, the ink filling process S14 according to the present invention is performed. In this respect, depending upon the hydrophilicizing method, before the ink holding member manufacturing process S11, in a process for manufacturing material for the ink holding member such as, for example, resin fibers, the hydrophilicizing treatment may be performed. After the ink tank assembling process S13, before the ink filling process S14 (more concretely, before S4 in the flow chart shown in FIG. 10), the hydrophilicizing treatment may be performed.

The description will be made of a still another modification according to the present invention while a new problem concerning the ink, with which the ink holding member is filled, is being disclosed.

Normally, the amount of ink poured into the ink tank is set to 100% or less of the internal void of the ink holding member, whereby it becomes possible to generate negative pressure by means of a capillary force in the ink holding member, thus making it possible to generate suitable back pressure to the ink jet head. This negative pressure also creates a state in which it is difficult for ink to move when an environmental change such as reduced pressure, temperature rise and drop, or an impact is imparted to the ink tank. In other words, appropriate negative pressure enables an ink tank which does not cause any ink leakage from the atmosphere communication port to be provided.

Figure 19A:
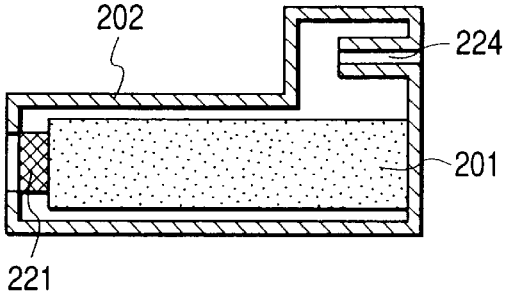
FIGS. 19A, 19B, 19C and 19D are explanatory views illustrating a state of the ink tank in an environmental change when the ink holding member in the ink tank is filled with ink substantially 100%.
Figure 19B:
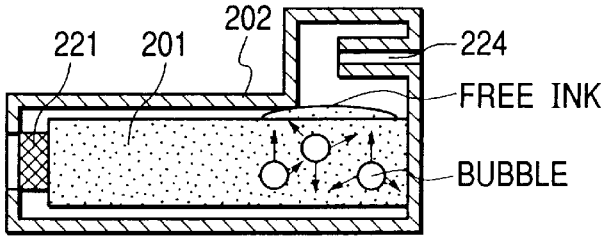

In contrast, FIGS. 19A to 19D are explanatory views illustrating a state of the ink tank in an environmental change when the ink holding member in the ink tank is filled with ink substantially 100%. FIG. 19A shows a state in which the ink holding member in the ink tank is filled with ink substantially 100%. A state of the ink tank when such an ink tank is left under a reduced pressure environment or a high temperature environment is shown in FIG. 19B. At this time, bubbles remaining within the ink holding member expand in volume due to reduced pressure or high temperature to push out the ink around them.

Figure 19C:
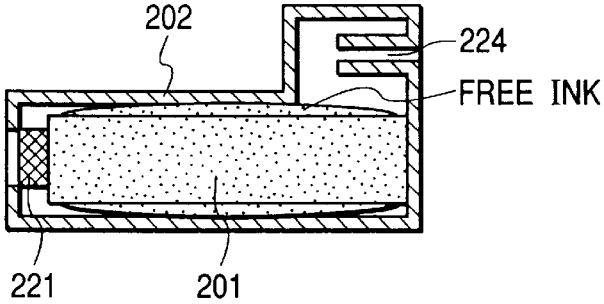

A state of the ink tank when the ink tank shown in FIG. 19A is left under a low-temperature environment is shown in FIG. 19C. At this time, the ink, with which the ink holding member has been filled, freezes at low temperature, and expands in volume to push out of the ink holding member.

Figure 19D:
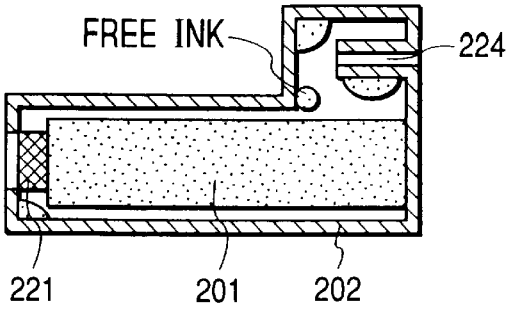

A state of the ink tank when an impact is imparted to the ink tank shown in FIG. 19A due to falling or the like is shown in FIG. 19D. At this time, when the ink, with which the ink holding member has been filled, is subjected to a greater impact force than the negative pressure generated by the ink holding member, the ink is pushed out from the ink holding member.

When the moving ink is discharged through the atmosphere communication port, the user may be contaminated with the ink. In order to effectively prevent this contamination, it is desirable to form a non-impregnated portion of the ink in the vicinity of the atmosphere communication port. In the conventional ink filling method using pressurization or reduced pressure, however, it is difficult to selectively provide the non-impregnated area of the ink.

In contrast, as a further modification of the present invention, an ink non-impregnated portion capable of exhibiting a buffer effect can be easily formed in the vicinity of the atmosphere communication port by providing positional relationship between the ink holding member and the ink tank and adopting an ink filling method according to the present invention.

Figure 20:
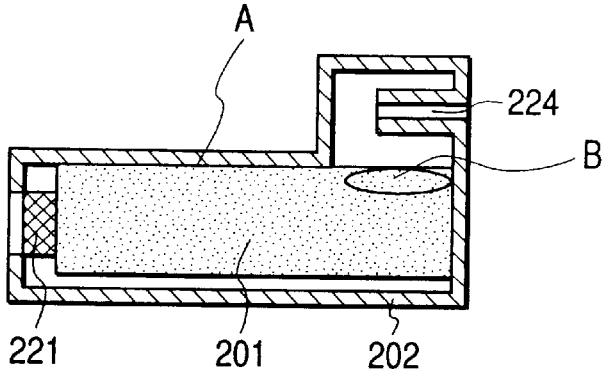
FIG. 20 is an explanatory view illustrating an ink-filled state of the ink tank to which the ink filling method according to the present invention is applied.

FIG. 20 is an explanatory view illustrating an ink-filled state of the ink tank to which the ink filling method according to the present invention is applied. An ink holding member 201 in the present modification is brought into tight contact with the inner wall of an ink housing 202 at a portion A. Ink filling according to the present invention is performed while the atmosphere communication port is turned upward in the direction of gravity as shown in FIG. 20, whereby it becomes possible to restrain the ink from moving to an area B of the ink holding member in the neighborhood of the atmosphere communication port, and therefore, the above described non-impregnated portion of the ink can be easily formed.

As described above, the hydrophilicizing treatment to be performed for the ink holding member is not performed on the atmosphere communication port side, whereby the ink movement to the atmosphere communication port side is restrained by taking advantage of the original hydrophobic nature of the resin fiber and the ink can be prevented from being discharged from the atmosphere communication port. According to this method, because of selectivity of the ink-filled portion, the non-impregnated portion of the ink capable of exhibiting the buffer effect can be easily formed in the vicinity of the atmosphere communication port without greatly deteriorating the ink filling ratio. As particularly shown in FIG. 20, the ink holding member is held within the ink tank housing, and the ink filling according to the present invention is performed while the atmosphere communication port is positioned above in the direction of gravity, whereby the non-impregnated portion of the ink can be easily formed more effectively in the area in the vicinity of the atmosphere communication port.

Figure 21A:
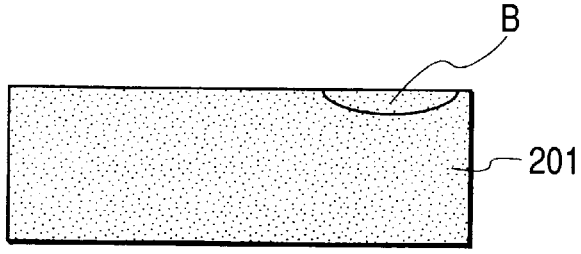
FIGS. 21A and 21B are explanatory views illustrating an example of a partial hydrophilicizing treatment of the ink holding member in the ink tank.
Figure 21B:
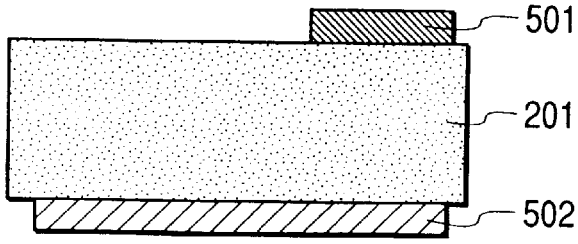
Figure 22A:
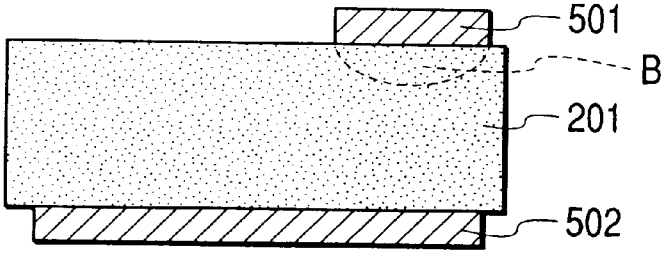
FIGS. 22A, 22B and 22C are explanatory views illustrating a modification of an example of the hydrophilicizing treatment shown in FIGS. 21A and 21B.
Figure 22B:
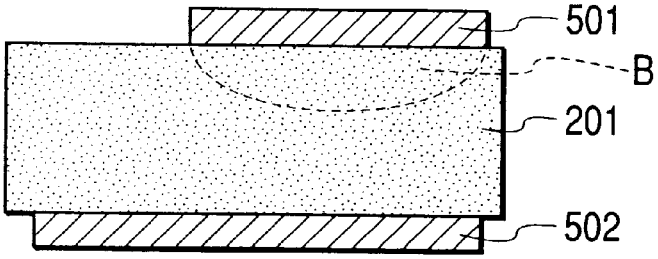
Figure 22C:
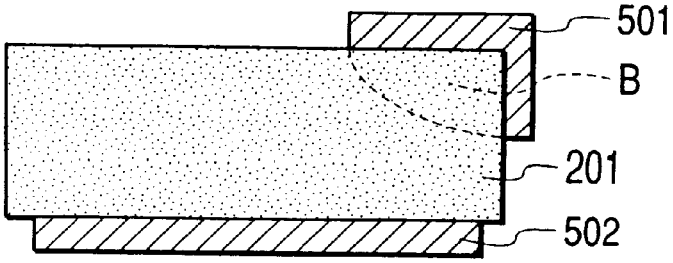

As regards partial selection of this hydrophilicizing treatment, an untreated portion can be easily selected by masking the holding member in the ink holding member hydrophilicizing process S12. FIGS. 21A and 21B are explanatory views illustrating an example of partial hydrophilicizing treatment of the ink holding member in the ink tank. For example, when an area B in FIG. 21A should be made into a non-impregnated area of the ink, the surface of portion B can be masked with a metallic plate 501 or the like as shown in FIG. 21B to perform the hydrophilicizing treatment. In this respect, in FIG. 21B, a reference numeral 502 designates mesh material, and the ink holding member is sandwiched between the metallic plate 501 and the mesh material 502 to thereby improve the handling in the hydrophilicizing treatment. FIGS. 22A to 22C are explanatory views for illustrating an example of modification of the hydrophilicizing treatment shown in FIGS. 21A and 21B. Each of FIGS. 22A to 22C shows an example of modification of the masked portion.

In this respect, as a method of the partial hydrophilicizing treatment, in addition to the method using the masking, it is also possible to control thickness of the untreated portion by controlling the impregnation time in the hydrophilicizing process S12. According to the experimental results by the present inventor, in order to display the hydrophobic nature of the resin fibers to the ink movement caused by the environmental change and the like, and to prevent the ink from being discharged from the atmosphere communication port, the suitable thickness of the untreated portion was found to be 5 mm or more.

Next, the description will be made of an ink filling apparatus according to further modification of the present invention. In the above described description, it has been exemplified that in order to impart an abrupt inertial force to the ink tank 200, the tank holding stage 101 is caused to move and collide with the stopper member 103 at rest, but it is also possible to leave the tank holding stage 101 at rest in a freely shiftable state and to cause the stopper member 103 moving to collide therewith.

Also, it has been exemplified that in order to impregnate the ink holding member 201 with the ink 1 at the highest efficiency, a direction, in which the ink 1 is poured into the ink tank 200, and a direction, in which the inertial force is imparted, are the same, this direction and the direction of fibers in the ink holding member 201 orthogonally intersect each other, and the ink pouring direction and the direction of gravity are orthogonal to each other.

However, combination of these directions can be changed in various ways, and for example, it is also possible to make the direction of fibers in the ink holding member 201 and the direction, in which the inertial force is imparted, identical. Further, it has been exemplified that an inertial force, whose direction is alternately reversed, is generated at the same intensity by moving the ink tank 200 back and forth at the same velocity. However, when the ink 1 is poured into the ink tank 200 from the front part as described above, it is also possible to differentiate the forward moving velocity of the ink tank 200 from the backward one in such a manner that the ink 1 favorably moves to the rear part of the ink holding member 201.

More specifically, when the direction of an inertial force to be imparted to the ink by the collision of the tank holding stage with-the stopper member is opposite to the ink pouring direction, the velocity of the tank holding stage at the collision may be set to be slower than a velocity of the stage when the stage moves in the opposite direction, whereby the ink is caused not to move by an inertial force in a direction opposite to the ink pouring direction, and the inertial force is imparted only in the ink pouring direction.

Figure 15:
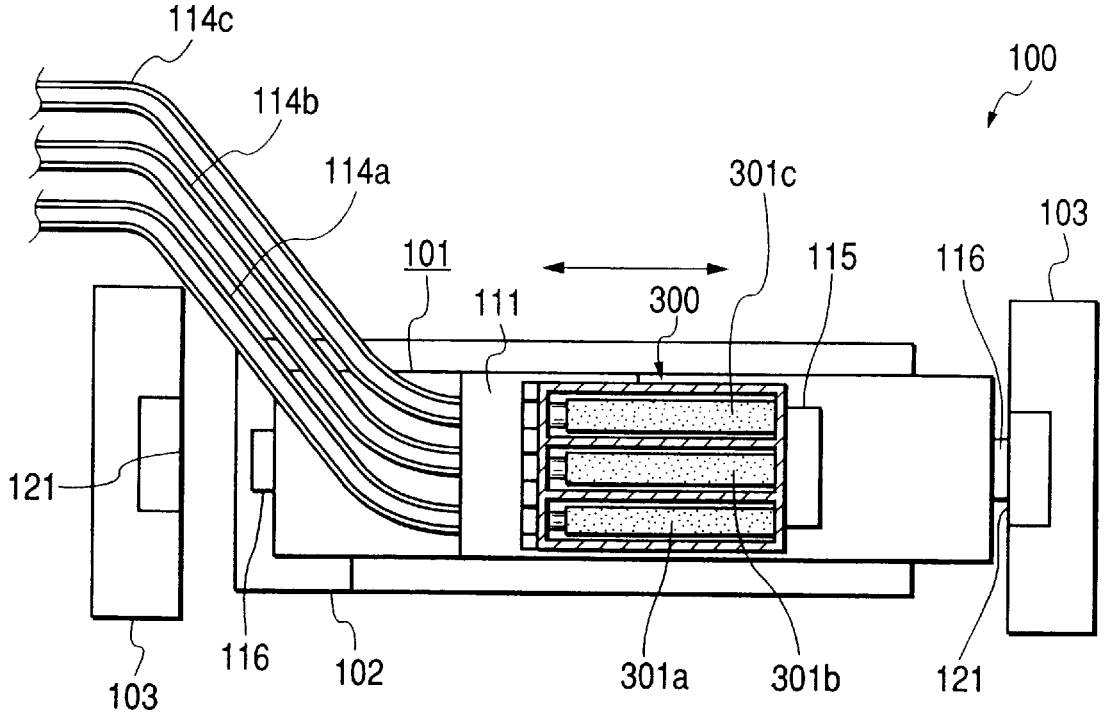
FIG. 15 is a side view showing an ink pouring device according to the second embodiment of the present invention.
Figure 16:
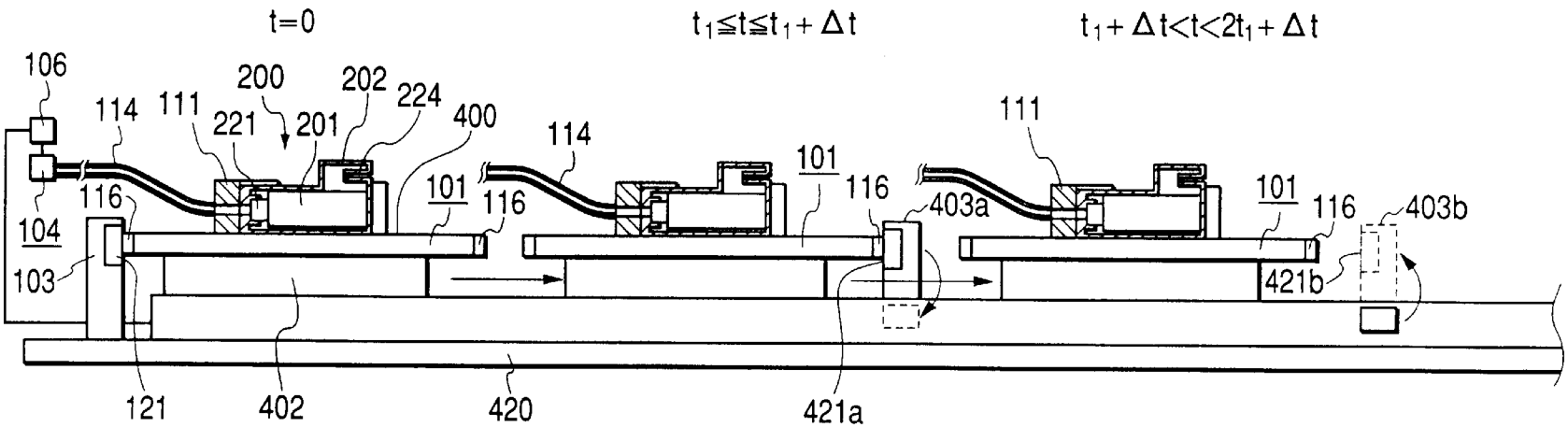
FIG. 16 is a side view showing an ink pouring device according to a modification of the present invention.
Figure 17:
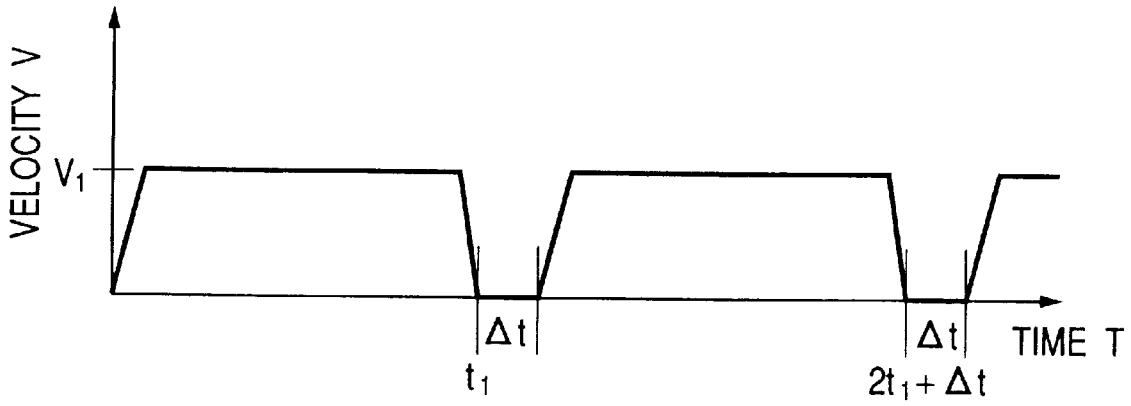
FIG. 17 is a time chart showing a moving operation according to a modification of the present invention.

In order to impart the inertial force only in the same direction as the ink pouring direction as described above, such an ink pouring device 400 as shown in FIGS. 15 and 16 may be used. In FIG. 13A, the ink pouring device 400 is different from the first embodiment in that the body base 420 is extended backward, and a plurality of stopper members 403*a*, 403*b*, . . . are arranged at equal intervals in the direction of its extension, and collision members 421*a*, 421*b*, . . . are arranged correspondingly to the stopper members 403*a*, 403*b*, . . . and a stopper member 403.

In this ink pouring device 400, the tank holding stage 101 moves by a moving mechanism 402 at t=0, it has a velocity $V_1$, and thereafter, collides with a first stopper member 403*a* at $t=t_1$ as shown in FIG. 15. After the collision, the stopper member 403*a* is housed within a body base 420 Δt seconds later, and the tank holding stage 101 starts the movement at velocity $V_1$ again. Thereafter, at $2t_1+\Delta t$, it collides with a second stopper member 403*b*. FIG. 16 is an explanatory view schematically illustrating states of the tank holding stage 101 at t=0, $t_1 \leqq t \leqq t_1+\Delta t$, and $t_1+\Delta t<t<2t_1+\Delta t$.

In this respect, even in the case of the ink pouring device 400 shown in FIG. 15, the forward inertial force is not only imparted to the ink by repeating movement and stoppage only in the forward direction (right direction shown) as in the case of the first embodiment, but also an inertial force, whose direction is reversed, may be imparted to the ink once or a plurality of number of times after the inertial force due to the movement in the forward direction is imparted a plurality of number of times.

Also, it has been exemplified that the ink I is pressurized and is supplied by an exclusive ink supply mechanism 104 to the ink tank 200 which is reciprocated, but it is also possible to mount, for example, a pumping system (not shown), which has a pouring valve and an exhaust valve and pressure-feeds liquid by oscillation, in the outside of the tank holding portion Ill for supplying the ink 1 to the ink tank 200 by means of its movement.

Further, in the first embodiment, it has been exemplified that the ink 1 of one color is poured into one ink holding member 201 in the ink tank 200, but an ink pouring device 100 according to the present invention is applicable to various type of ink tanks such as, for example, one ink tank for individually holding ink of black and red colors by ink holding members in two liquid chambers, one ink tank for individually holding ink of three primary colors by ink holding members in three liquid chambers, and one ink tank (not shown) for individually holding ink of three primary colors and black color by ink holding members in four liquid chambers.

Further, in the above described embodiment, as an inertial force imparting mechanism for simply imparting an abrupt inertial force to the ink tank 200, there has been exemplified structure in which the tank holding stage 101 is caused to collide with the stopper member 103, which is a stage stopper member, but this will suffice so long as a necessary inertial force can be generated. For example, it is also possible to connect wire having predetermined length and high strength to the tank holding stage 101 and the body base 120 for generating a predetermined inertial force by means of tension of this wire, and it is not impossible to generate a necessary inertial force even for an abrupt reversing operation of the stage moving mechanism 102.

Each of the above described embodiments has a process of pouring ink into the housing and imparting an inertial force to the ink, and a process of imparting an inertial force to the ink within the housing after the ink is poured, but depending upon the amount of poured ink, only a process of pouring the ink into the housing and imparting an inertial force to the ink is enough, and it may be possible not to pour all of a predetermined amount of the ink first, but to set the above described two processes to one set for repeating a series of operations until the predetermined amount of the ink is poured.

According to the ink filling method of the present invention as described above, a great inertial force is abruptly imparted to ink poured into the ink tank and this inertial force moves the ink into the ink holding member, whereby the ink holding member is impregnated with the ink irrespective of its hydrophobic nature and hydrophilic nature, and therefore the ink can be quickly poured into the ink tank to impregnate the ink holding member with the ink even when the ink holding member displays the hydrophobic nature to the ink.

Also, by instantaneously stopping the ink tank, which is moving, to thereby impart the inertial force to the ink, for example, by a simple operation such as causing a stage, which holds the ink tank for moving, to collide with the stopper, it is possible to impart sufficient inertial force to the ink, and to quickly impregnate the ink holding member with the ink.

Since the inertial force is repeatedly imparted to the ink whereby the ink is repeatedly moved within the ink tank, the entire ink holding member can be favorably impregnated with the ink.

Since the direction, in which the ink moves within the ink tank, is alternately reversed by alternately reversing the direction of the inertial force to be repeatedly imparted to the ink by a simple operation such as reciprocating the ink tank, the entire ink holding member can be favorably impregnated with the ink.

In the ink pouring device according to the present invention, the inertial force imparting mechanism abruptly imparts a great inertial force to the ink to be poured into the tank container in the ink tank from the ink supply mechanism through the ink supply port, whereby this inertial force moves the ink within the ink holding member to impregnate the ink holding member with the ink irrespective of the hydrophobic nature and hydrophilic nature, and therefore, the ink can be quickly poured into the ink tank to impregnate the ink holding member with the ink even when the ink holding member displays the hydrophobic nature to the ink.

What is claimed is:

1. An ink filling method for filling, with ink, an ink holding member in an ink tank, which comprises an ink holding member for holding the ink, an ink supply port supplying the ink in said ink holding member to the outside, and a housing for containing said ink holding member and having an atmosphere communication port for communicating said ink holding member to atmosphere, comprising the steps of:

pouring a predetermined amount of the ink into said housing in a state in which said ink holding member is opened to the atmosphere; and filling said ink holding member with the ink by imparting, to the ink poured, an inertial force, which is greater than a sum of a static ink holding force of said ink holding member and a dynamic resistant force to movement of the ink.

2. The ink filling method according to claim 1, wherein said ink is poured through said ink supply port.

3. The ink filling method according to claim 1, wherein an inertial force is imparted to said ink by instantaneously stopping said ink tank which is moving.

4. The ink filling method according to any one of claims 1 to 3, wherein said inertial force is repeatedly imparted to said ink.

5. The ink filling method according to claim 4, wherein a direction of said inertial force to be repeatedly imparted to said ink is alternately reversed.

6. The ink filling method according to claim 1, further comprising a second inertial force imparting process for filling, after said filling process, said ink holding member with said ink by imparting, to said ink poured, an inertial force, which is greater than a sum of a static ink holding force of said ink holding member and a dynamic resistant force to movement of said ink.

7. The ink filling method according to claim 6, wherein said second inertial force imparting process is performed in a state in which said ink holding member is hermetically sealed from the atmosphere.

8. The ink filling method according to claim 6, wherein said housing and the outer surface of said ink holding member oppose to each other when at least one portion of the two has a gap.

9. The ink filling method according to claim 1, wherein in said filling process, said ink holding member is opened to the atmosphere by opening said atmosphere communication port and said ink is poured in a state in which said atmosphere communication port is positioned above said ink holding member.

10. The ink filling method according to claim 1, wherein said ink holding member is made of a multiplicity of fibers having hydrophobic nature to said ink.

11. The ink filling method according to claim 10, further comprising a process of hydrophilicizing fibers having said hydrophobic nature prior to said filling process.

12. The ink filling method according to claim 11, wherein said process of hydrophilicizing fibers having said hydrophobic nature uses a surface-active agent.

13. The ink filling method according to claim 12, wherein an ink holding member for holding said ink is partially hydrophilicized.

14. The ink filling method according to claim 13, wherein said ink holding member for holding said ink is hydrophilicized except a surface thereof on the atmosphere communication port side.

15. The ink filling method according to claim 14, wherein thickness of said ink holding member for holding said ink, which is not hydrophilicized, is 5 mm or more.

16. The ink filling method according to claim 10, wherein said fibers are focused in the substantially same direction which intersects a direction of said inertial force imparted.

17. The ink filling method according to claim 1, wherein there are provided a plurality of said ink holding members, and each of said ink holding members is filled with said ink at the same time in said filling process.

* * * * *

UNITED STATES PATENT AND TRADEMARK OFFICE

CERTIFICATE OF CORRECTION

PATENT NO. : 6,390,612 B1
DATED : May 21, 2002
INVENTOR(S) : Yasuo Kotaki et al.

It is certified that error appears in the above-identified patent and that said Letters Patent is hereby corrected as shown below:

Column 3,
Line 2, “an” should be deleted.

Column 6,
Line 32, “is” should read -- is a --.

Column 8,
Line 7, “executed” should read -- being executed --.

Column 10,
Line 2, “(Step” should read -- (Steps --; and
Line 9, “an” should read --a --.

Column 11,
Line 16, “(Step S2, 7),” should read -- (Steps S2, S7), --; and
Line 60, “these” should read -- this --.

Column 12,
Line 47, “contain” should read -- containing --;
Line 51, “contain” should read -- containing --;
Line 55, “contain” should read -- containing --; and “i n th e” should read -- in the --; and
Line 64, “contain” should read -- containing --.

Column 14,
Line 18, “a” should be deleted.

Column 16,
Line 33, “with-the” should read -- with the --.

UNITED STATES PATENT AND TRADEMARK OFFICE

CERTIFICATE OF CORRECTION

PATENT NO. : 6,390,612 B1
DATED : May 21, 2002
INVENTOR(S) : Yasuo Kotaki et al.

It is certified that error appears in the above-identified patent and that said Letters Patent is hereby corrected as shown below:

Column 17,
Line 3, “ink I” should read -- ink l --;
Line 8, “portion Ill” should read -- portion 111 --; and
Line 14, “type” should read -- types --.

Signed and Sealed this

Twenty-first Day of January, 2003

JAMES E. ROGAN
*Director of the United States Patent and Trademark Office*